US007593684B2

(12) United States Patent
De Jong et al.

(10) Patent No.: US 7,593,684 B2
(45) Date of Patent: Sep. 22, 2009

(54) SYSTEMS AND METHODS FOR MEDIUM REGISTRATION

(75) Inventors: Joannes N. M. De Jong, Hopewell Junction, NY (US); Vittorio Castelli, Yorktown Heights, NY (US); Daniel C Park, West Linn, OR (US); Lloyd A Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 879 days.

(21) Appl. No.: 11/213,968

(22) Filed: Aug. 30, 2005

(65) Prior Publication Data

US 2007/0048054 A1 Mar. 1, 2007

(51) Int. Cl.
*B41J 29/38* (2006.01)
*G03G 15/00* (2006.01)
*B65H 7/02* (2006.01)

(52) U.S. Cl. ..... 399/395; 271/227; 347/16

(58) Field of Classification Search ..... 347/16
See application file for complete search history.

(56) References Cited

U.S. PATENT DOCUMENTS 4,971,304 A * 11/1990 Lofthus ..... 271/227
5,678,159 A 10/1997 Williams et al.
5,696,893 A * 12/1997 Fromherz et al. ..... 358/1.13
5,732,943 A * 3/1998 Delfosse ..... 271/228
2006/0239733 A1* 10/2006 Choi et al. ..... 399/396
2007/0023994 A1* 2/2007 Mandel et al. ..... 271/226

FOREIGN PATENT DOCUMENTS

JP 11-282825 * 10/1999

* cited by examiner

*Primary Examiner*—Julian D Huffman
(74) *Attorney, Agent, or Firm*—Oliff & Berridge, PLC

(57) ABSTRACT

Embodiments according to the present disclosure provide methods and systems of determining nip velocity profiles in a medium registration system, including parameterizing a set of equations into a set of standard parameters, the set of equations representing an analytic form of the nip velocity profiles; determining values of the parameters through an iteration process; and determining the nip velocity profiles based on the determined values of the parameters. The embodiments separately provide systems and methods of simulating a medium registration process, including inputting an error parameter to a velocity nominal profile of a nip in a medium registration system; determining an output value of the velocity nominal profile; and using the output value in a regression algorithm to obtain a simulated relationship, the simulated relationship indicative of a manner in which the error parameter influences the output value. The embodiments separately provide systems and methods of determining an angular velocity of a medium relative to a nip in a medium registration system, including determining a path of the nip on the medium; and determining the angular velocity as a function of a position of the nip in the path. The embodiments separately provide systems and methods of controlling nips of a medium registration system, including wagging a medium relative to a center line of two nips of the medium registration system; and then unwagging the medium relative to the center line of the two nips.

25 Claims, 34 Drawing Sheets

FIG. 1
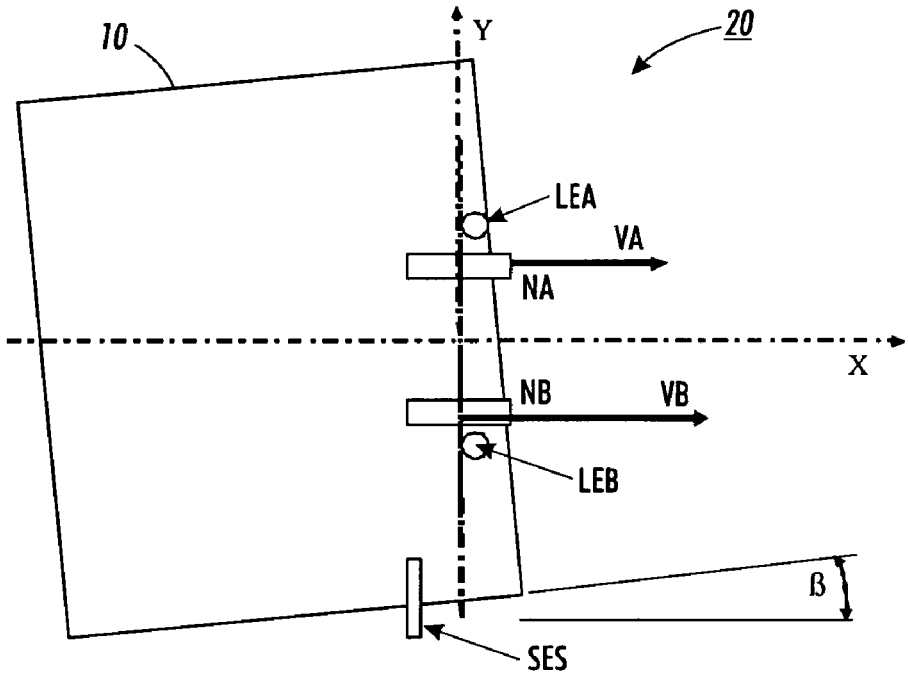
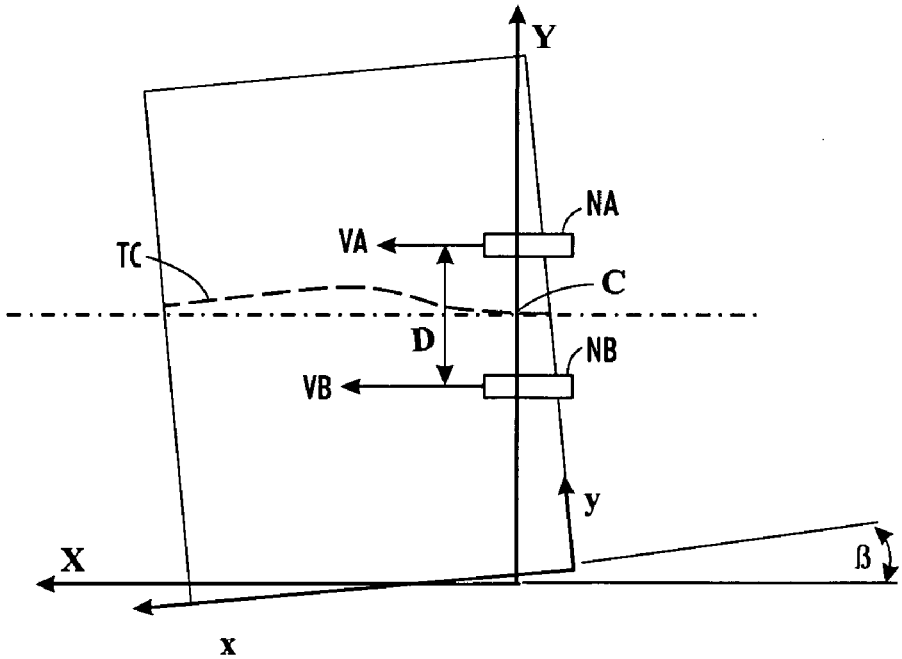
FIG. 2

FIG. 8
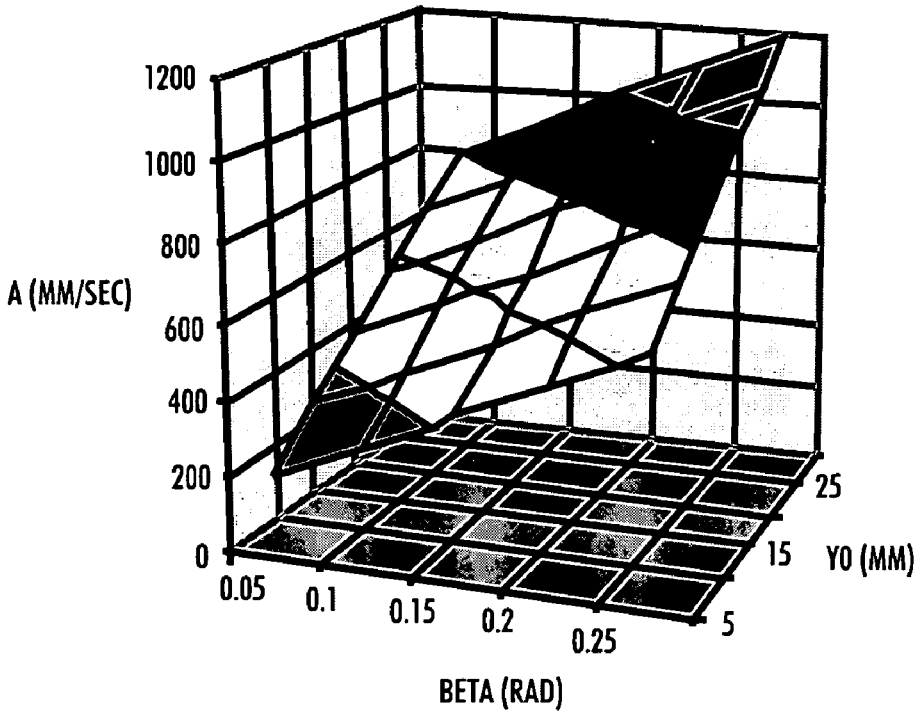
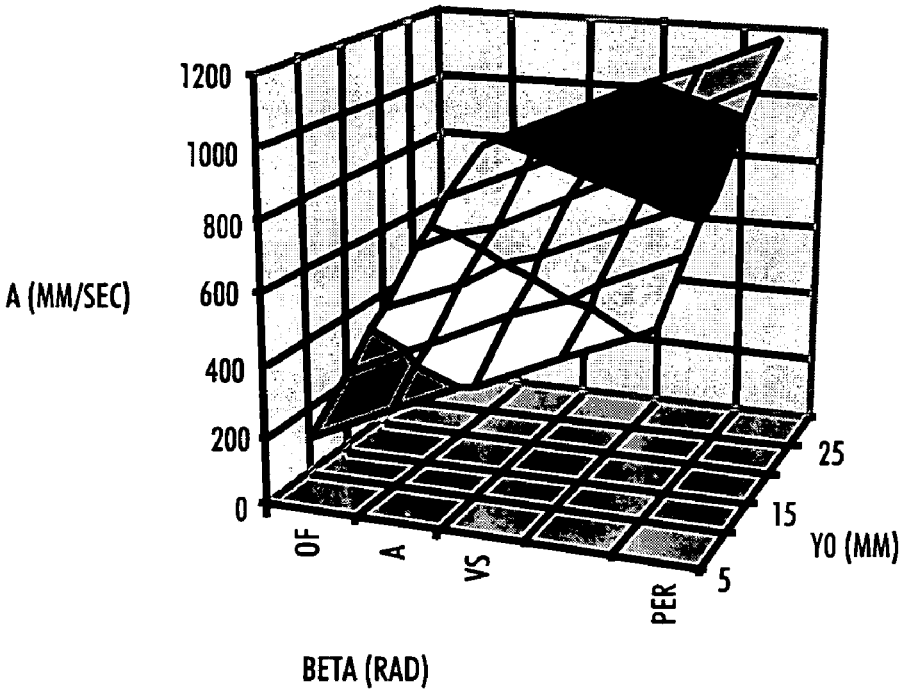
FIG. 9

FIG. 10
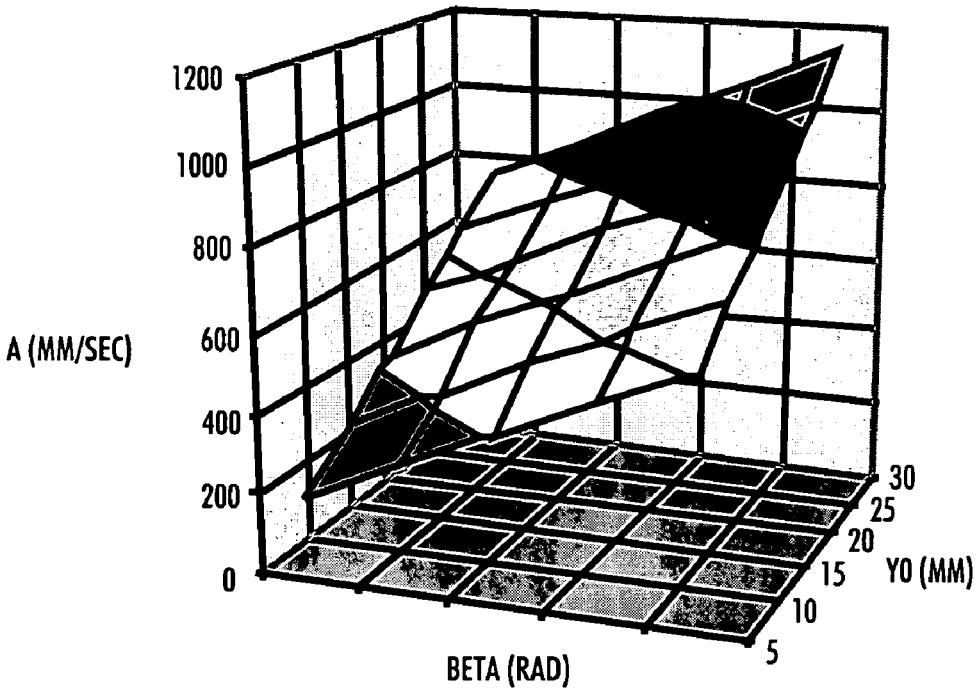
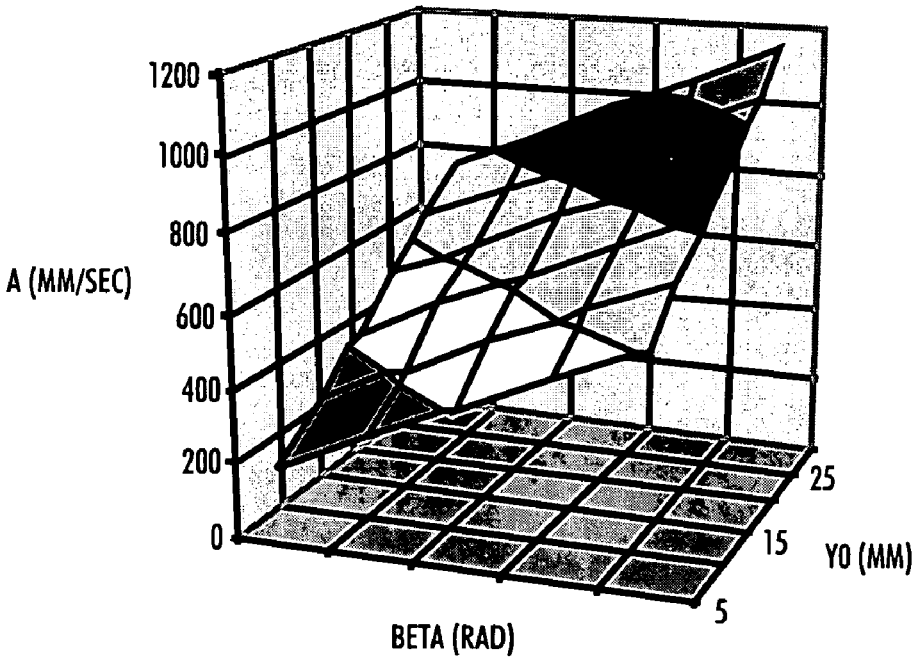
FIG. 11

FIG. 12
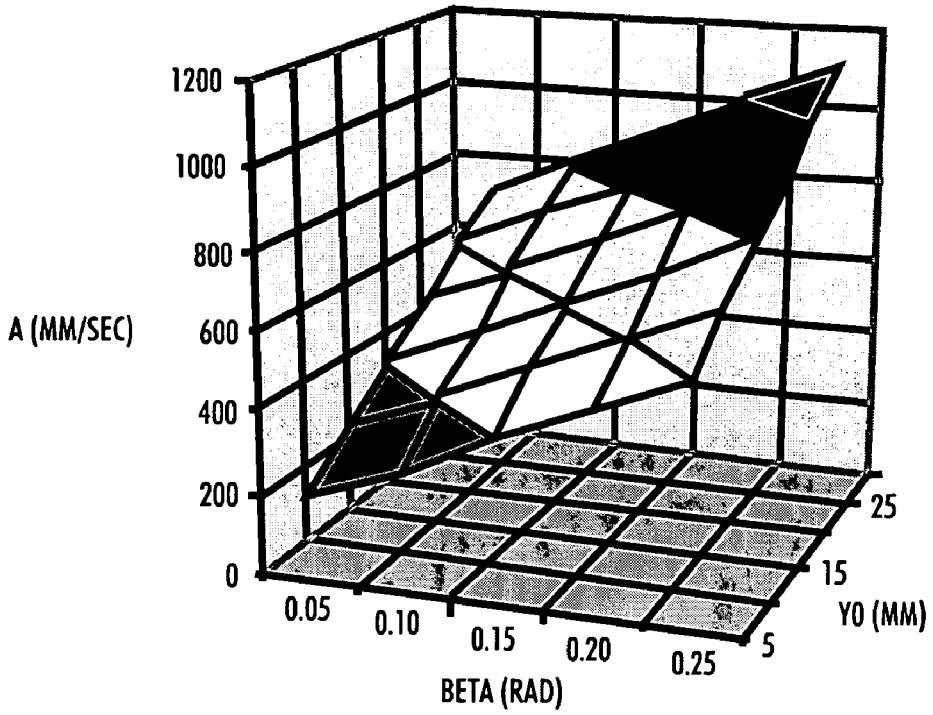
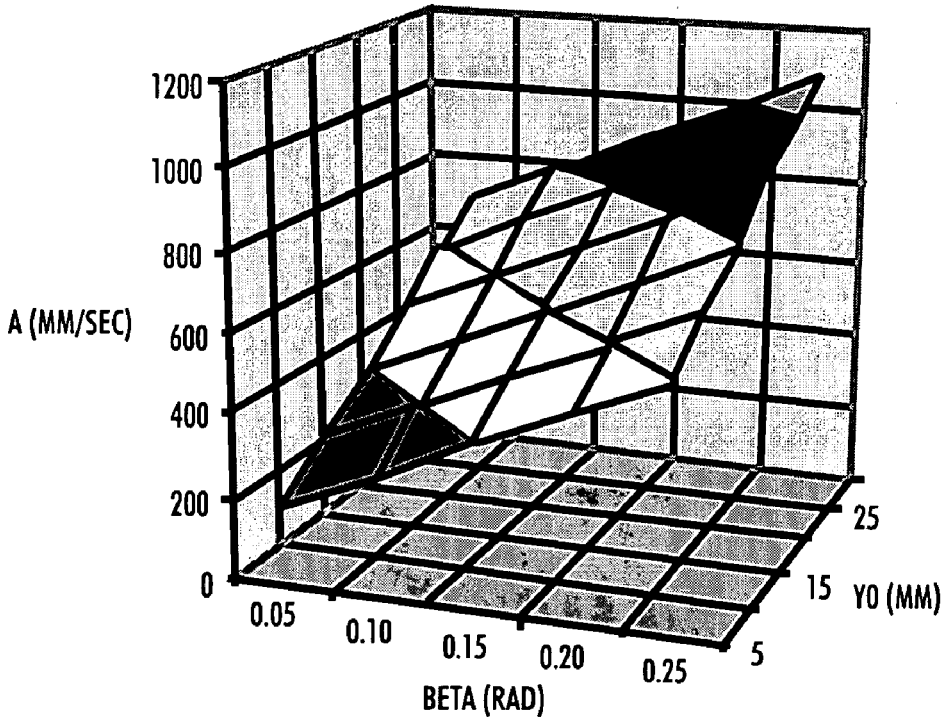
FIG. 13

FIG. 14
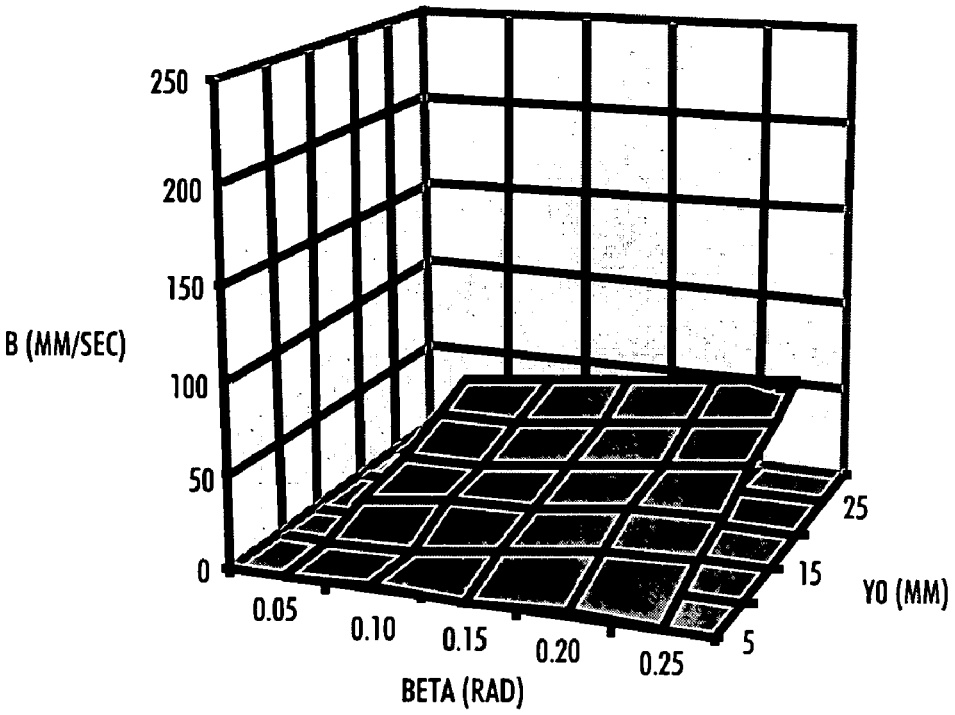
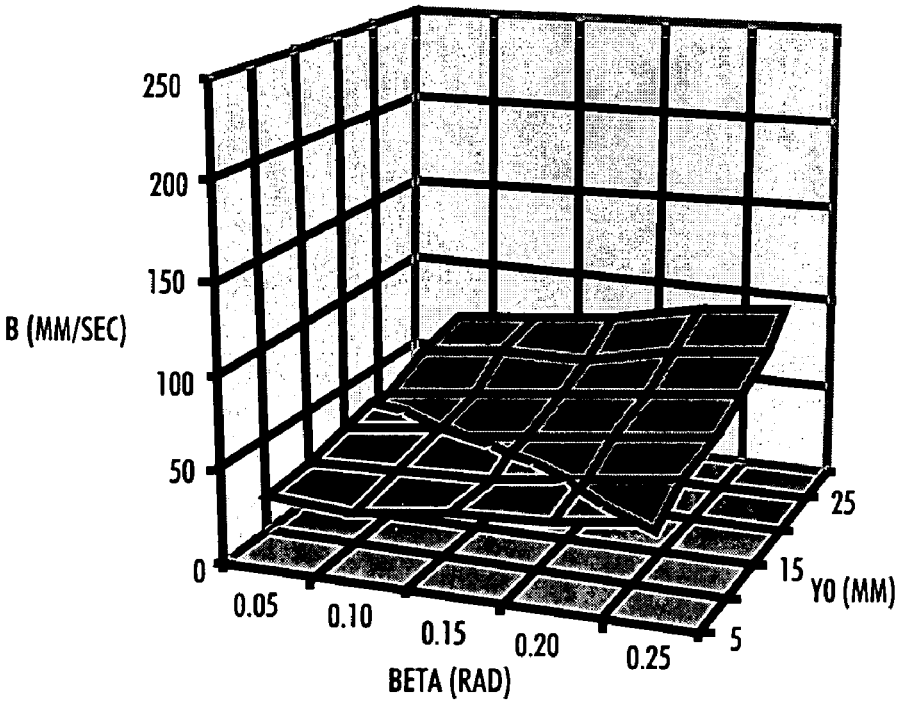
FIG. 15

FIG. 16
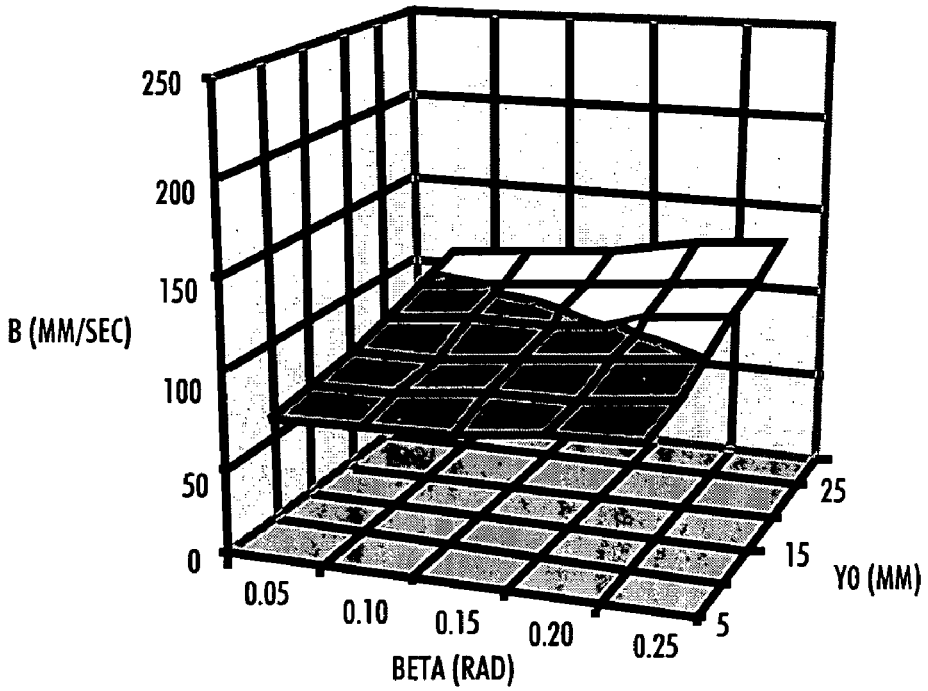
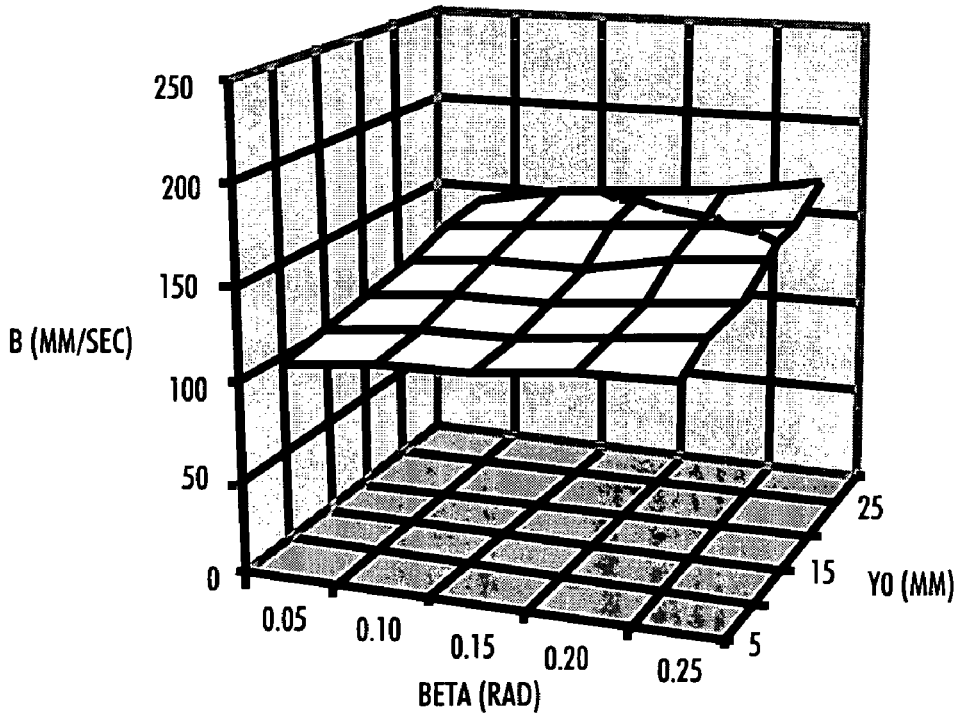
FIG. 17

FIG. 18
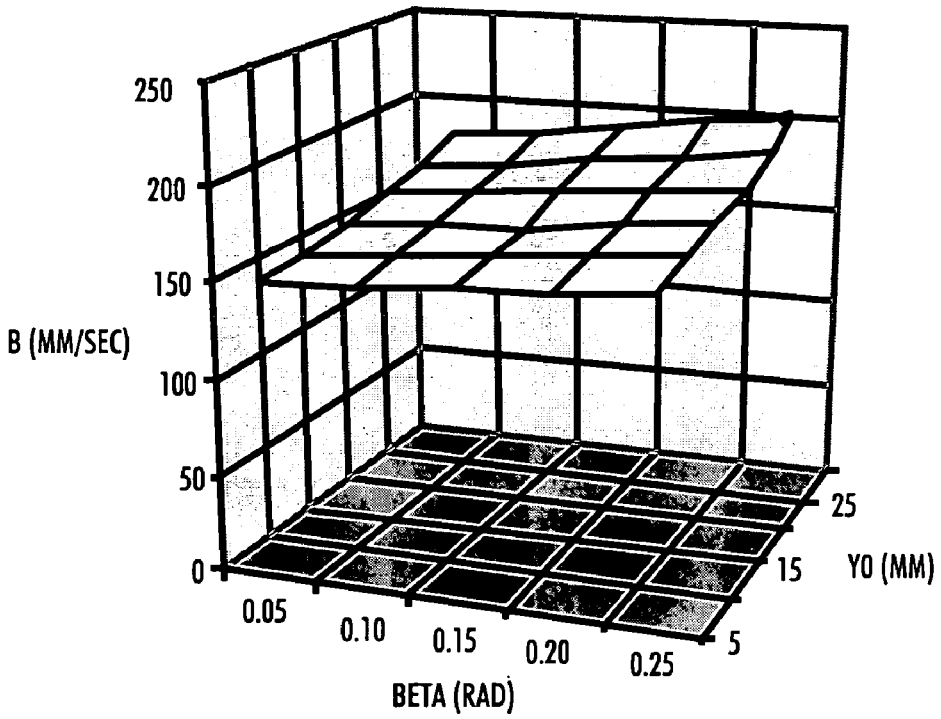
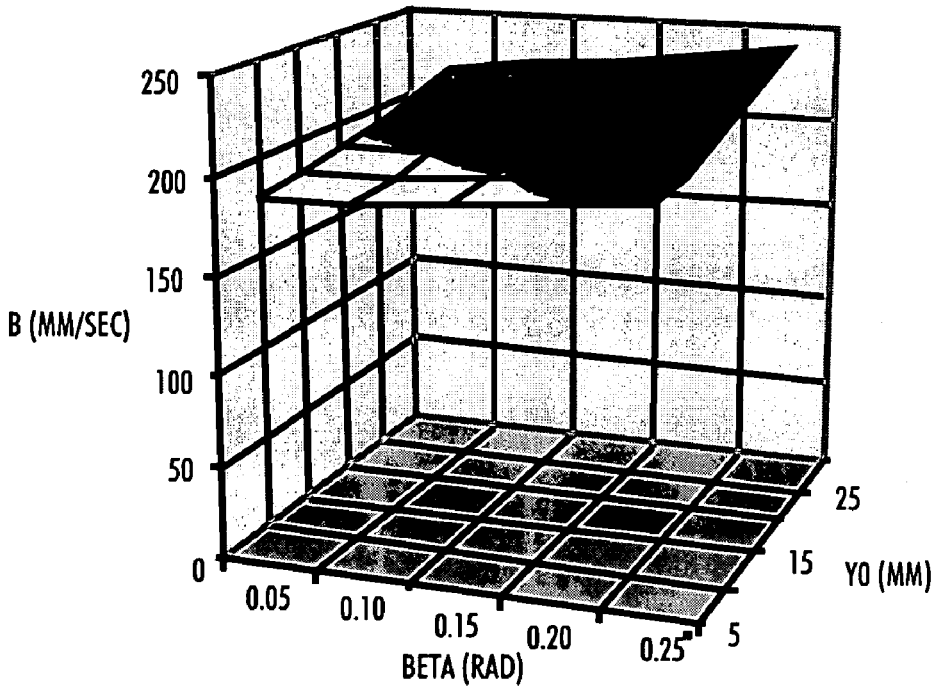
FIG. 19

SYSTEMS AND METHODS FOR MEDIUM REGISTRATION

Cross-reference is made to U.S. Pat. No. 5,678,159 issued Oct. 14, 1997 to Williams et al., which is herein incorporated by reference in its entirety.

BACKGROUND

The purpose of medium registration system is to properly register sheets of a medium such as a sheet of paper or transparency material. For example, in a scanner or printer, a sheet of paper needs to be properly registered at a pair of nips (also called wheels or rollers) so that an image can be properly rendered on the sheet of paper.

In the medium registration system, one or more sensors may be used to detect the position and/or orientation of the medium relative to a process direction. The process direction denotes the main direction in which the media progress. The speed or velocity of the nips may be described as functions of time. The velocity profiles of the nips may be controlled in a medium registration process.

SUMMARY

For properly registering media, a complex algorithm may be required for generating nip velocity profiles and for controlling the speed of the nips. In addition, costly computational hardware may also be needed.

When moving along a path in a process direction, media may deviate from an ideal nominal process velocity. Such a deviation may result in a deviation from a planned path, and thus result in a media registration error.

Embodiments according to the present disclosure provide methods and systems of establishing nip velocity profiles in a medium registration system, including defining a set of equations containing parameters, the set of equations representing an analytic form of the nip velocity profiles; determining values of the parameters through an iteration process; and determining the nip velocity profiles based on the determined values of the parameters.

The embodiments separately provide systems and methods of simulating a medium registration process, including inputting an error into a velocity nominal profile of a nip in a medium registration system; determining an output value of the nominal velocity profile; and using the output value in a regression process to obtain a simulated relationship, the simulated relationship indicative of a manner in which the error influences the output and of the accuracy of the solution.

The embodiments separately provide systems and methods of determining an angular velocity of a medium in a medium registration system, including determining a path of the nip on the medium; and determining the angular velocity as a function of a position of the center of the nips in the path.

The embodiments separately provide systems and methods of controlling nips of a medium registration system, including wagging a medium relative to a center line of two nips of the medium registration system; and then unwagging the medium relative to the center line of the two nips. The term wagging means a rotation of the medium that causes its tail end to move laterally with respect to the process direction, where process direction refers to the main direction of progress of the medium in the machine in question. The term unwagging refers to the elimination of the above-mentioned lateral movement.

These and other features and details are described in, or are apparent from, the following detailed description.

BRIEF DESCRIPTION OF THE DRAWINGS

Various exemplary details of systems and methods are described, with reference to the following figures, wherein:

FIG. 1 illustrates a medium registration system;

FIG. 2 illustrates the relative movement between a medium and a pair of nips;

FIGS. 8 through 19 illustrate examples of multidimensional space of velocity profile parameters;

DETAILED DESCRIPTION OF EMBODIMENTS

Figure 3:
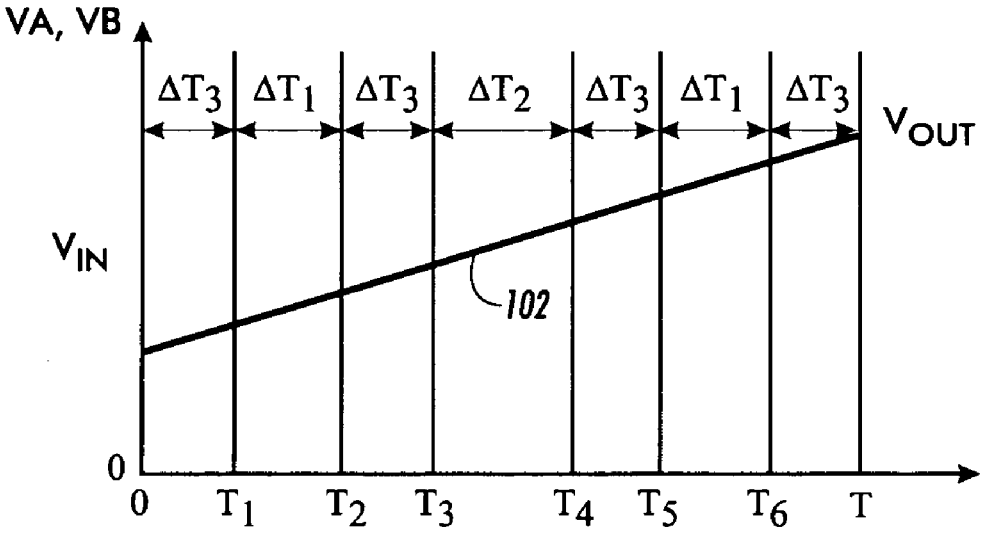
FIG. 3 illustrates a velocity ramp.

FIG. 1 illustrates a medium registration system 20. As shown in FIG. 1, the medium, such as a sheet of paper 10, moves along a process direction (X-direction) towards stationary nips NA and NB. The nips NA and NB impart velocity vectors VA and VB on the sheet 10 in the X-direction. The average velocity (VA+VB)/2 provides an X-direction motion to the sheet 10. The difference (VA−VB) provides a rotation of the sheet 10.

The sheet of paper 10 may be delivered to a device downstream (not shown). The device downstream may be a photoreceptor, a drum, or any other appropriate device that is capable of receiving or delivering an image. The device downstream may include another set of nips.

It is desirable that medium delivery strategies calculate velocity profiles VA and VB as functions of time t to deliver the sheet of paper 10 from an initial condition to an end condition. In particular, it is desirable that velocity profiles VA and VB be calculated accurately to achieve precise medium delivery or paper registration. More discussion related to medium registration may be found in U.S. Pat. No. 5,678,159.

As shown in FIG. 1, the sheet 10 may be at an angle β with the X-direction. The angle β may be caused by the rotation of the sheet provided by the difference (VA−VB). The angle β may also be a combination of an initial angle $\beta_0$ and the rotation caused by the difference (VA−VB).

Before the sheet of paper 10 enters the nips NA and NB, the velocities VA and VB may be set equal to a paper velocity V0 of an upstream paper path (not shown). Such velocities may be assured by correct hand-off of the sheet of paper from the upstream path to the medium registration system 20 shown in FIG. 1. As shown in FIG. 1, the medium registration system 20 may include lead edge sensors LEA and LEB, and a lateral or a side edge sensor SES.

A registration process may commence shortly after the arrival of the sheet of paper 10, as detected by sensors LEA and LEB. The sensors LEA and LEB report a time of arrival, an initial process position $x_0$, and an initial angle $\beta_0$ of the sheet of paper 10. The lateral sensor SES may report an initial lateral position or Y-direction offset $y_0$ in the Y-direction or cross process direction. A lead-edge center, or lead-edge side may be considered the point that has been registered. Geometric calculation may yield values for the initial conditions of the paper sheet from sensor measurements.

The velocity profiles VA(t) and VB(t) may be computed or otherwise determined to deliver the sheet of paper 10 at a position $X_f$, $y_f$, $\beta_f$ at a time $t_f$ with velocity $v_f$. For example, the velocity vf may be provided to match the velocity required by the downstream device.

FIGS. 2 through 20 are referred to for the discussion of systems and methods for generating velocity profiles, such as velocity profiles VA(t) and VB(t). As shown in FIG. 2, the movement of the sheet of paper 10 relative to the nips NA and NB may be described as the movement of nips NA and NB relative to the sheet of paper 10. In particular, the center point C of the distance D between the nips NA and NB may be considered to travel on a stationary sheet 10. For example, the center C may be considered to follow a path Tc as a consequence of the velocity vectors VA and VB. The path Tc is a trajectory of the center C on the sheet of paper 10.

When the nips NA and NB are at the end of the path Tc, the sheet of paper 10 needs to be registered. This is the position where hand-off to a next device occurs. In addition, at this position, the angle of the sheet 10 relative to the X-direction may have changed from an initial value $\beta_0$ to a final value $B_f$. The lateral position may have changed by a value $\Delta y = y_f - y_0$. The nips, also called wheels or rollers, may have traveled a distance $x_f - x_0$ in a time $t_f - t_0$.

The movement of the nips NA and NB relative to the sheet of paper 10 may be specified by a path velocity V(t) and an angular velocity W(t) as follows:

$$V(t) = \frac{ds}{dt} = \frac{VA(t) + VB(t)}{2} = V_{AVG}(t) \tag{1}$$

$$\omega(t) = \frac{d\beta}{dt} = \frac{VA(t) - VB(t)}{D} \tag{2}$$

where s denotes progress along the path of the nips or the center point C; β denotes the angle of the path of the nips; D denotes the distance between the two nips; and $V_{AVG}$ denotes the average of VA and VB. In addition, the X-direction component Vx(t) and the Y-direction component Vy(t) of the path velocity V(T) may be expressed as:

$$V_x(t) = \frac{dx}{dt} = V_{AVG}(t)\cos\beta \tag{3}$$

$$V_y(t) = \frac{dy}{dt} = V_{AVG}(t)\sin\beta \tag{4}$$

where x denotes the X-direction coordinate of the path of the nips, and y denotes the Y-direction coordinate of the path of the nips.

Solving equations 1 through 4 may require complex computation. In addition, equations 1 through 4 may be integrated in closed form only for small values of the angle β. Thus, it is desirable to determine the velocity profiles using simple functions and parameters.

For example, the determination of the velocity profiles may be based on four segments of standard functions, as shown in FIGS. 3 through 6, and the parameters listed in Table 1, as discussed below.

TABLE 1

| PARAMETERS |
|---|
| $x_f$ = desired final x-position |
| Δβ = desired change of angle |
| Δy = desired change of lateral position |
| $T_f$ = desired final time at which $x = x_f$ |
| T = chosen time for the move. At t = T, $x = x_1$ |
| $\Delta T_1$ = chosen dwell in the trapezoid |
| $\Delta T_2$ = chosen dwell between trapezoids |
| $\Delta T_3$ = chosen ramp time = $0.25(T - \Delta T_2) - 0.5\Delta T_1$ |
| $x_1$ = needed x-position at t = T. |
| NOTE that $x_1 = x_f - Vout\ (T_f - T)$ |
| A = needed amplitude of y-move velocity trapezoid |
| B = needed amplitude of x-move velocity trapezoid |
| ΔA = needed amplitude of angle-move velocity trapezoid. NOTE: $\Delta A = 0.5\ (\Delta\beta)/[D(T - \Delta T_3)]$ |

In particular, FIG. 3 shows a velocity ramp 102, as a first segment of standard functions. As shown in FIG. 3, the velocity ramp 102 indicates a change in speed. For example, VA or VB may change in time from a first (or initial) speed $V_{in}$ to a second (or final) speed $V_{out}$.

Figure 4:
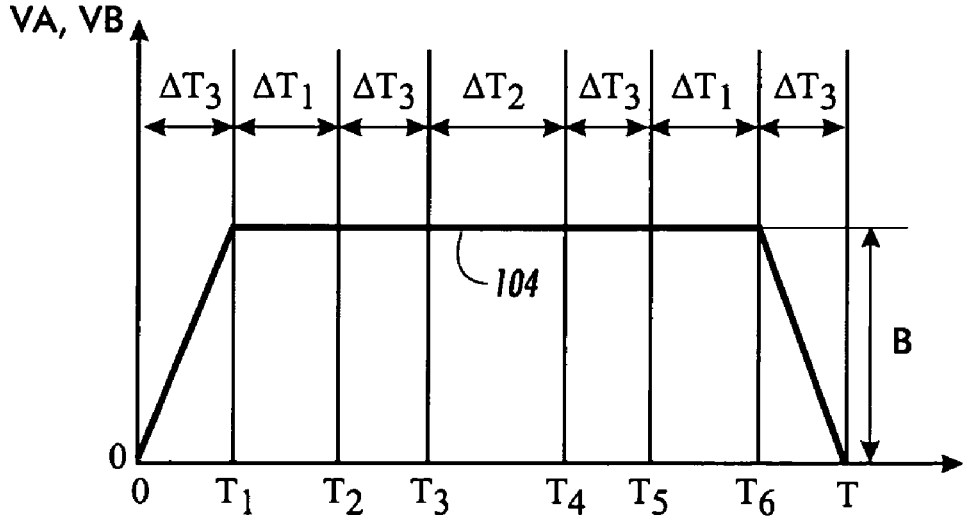
FIG. 4 illustrates a velocity profile.

FIG. 4 shows a velocity profile 104, as a second segment of standard functions. As shown in FIG. 4, the velocity profile 104 includes a velocity jog B. The velocity jog B indicates a change of velocity VA or VB in the X-direction.

Figure 5:
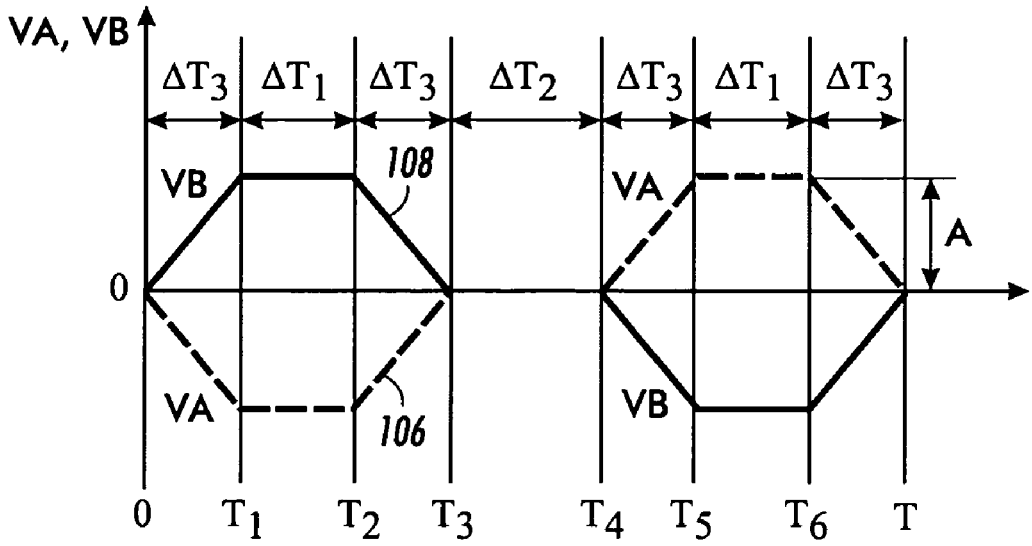
FIG. 5 illustrates velocity profiles with crossed trapezoids.

FIG. 5 shows a third segment of standard functions. As shown in FIG. 5, the velocity profiles 106 and 108 form crossed trapezoids. The velocity profile 106 may be the profile of one of VA and VB, while the velocity profile 108 may be the profile of the other of VA and VB. The velocity profiles 106 and 108 indicate a change in Y-direction position while there is no change in the angle β.

Figure 6:
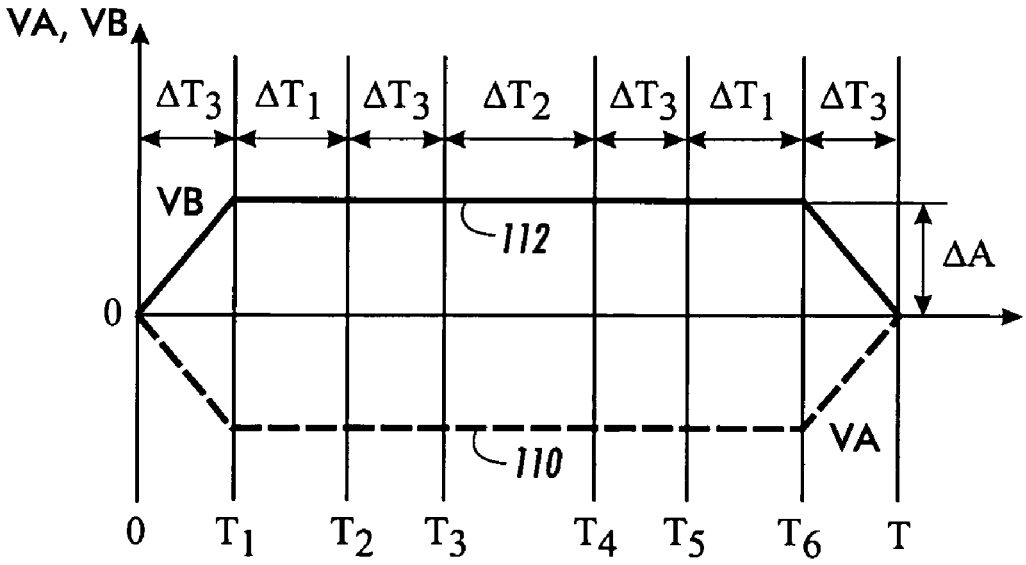
FIG. 6 illustrates velocity profiles with opposite trapezoids.

FIG. 6 shows a fourth segment of standard functions. As shown in FIG. 6, the velocity profiles 110 and 112 form opposite trapezoids. The velocity profile 110 may be the profile of one of VA and VB, while the velocity profile 112 may be the profile of the other of VA and VB. For example, the velocity profile 110 may be the profile of VA, and the velocity profile 112 may be the profile of VB. The velocity profiles 110 and 112 indicate a change in the angle β while there is no change in Y-direction position.

In FIGS. 3 through 6 and Table 1, time T may be chosen as a standard value, or one of a set of values. The parameter $x_1$ may be derived. The parameters $\Delta T_1$, $\Delta T_2$, and $\Delta T_3$ may be chosen as standard fractions of T. The parameter ΔA may be computed. For each registration process, it is desirable that the parameters A and B be determined as functions of $x_1$, Δy, and ΔB.

Figure 7:
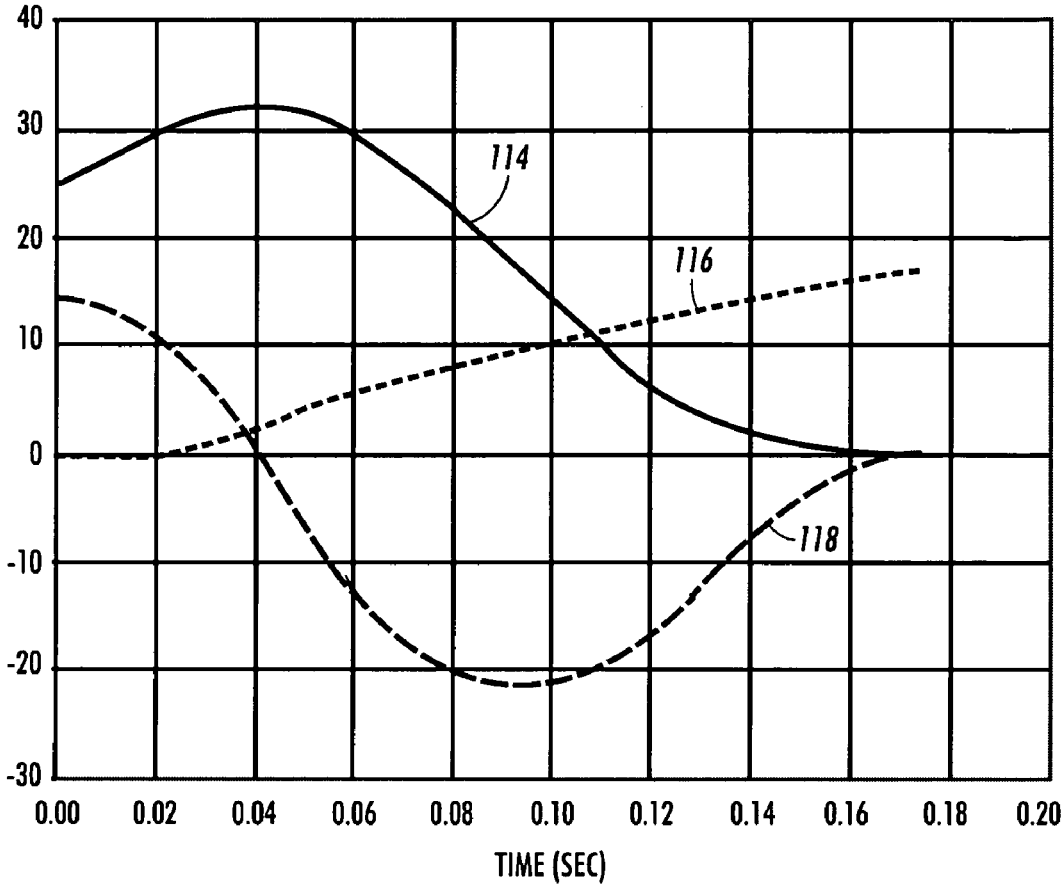
FIG. 7 illustrates convergence of a lateral offset.

The parameters $x_1$, Δy and ΔB may be determined by an iterative or an interpolation process. FIG. 7 illustrates that the lateral offset, as described by the curve 114, converges to the value 0.

In FIG. 7, the curve 116 represents the behavior in time of parameter XDEV that is equal to difference between the actual x-position and the x-position that the sheet would have had due to the straight line profile 102 shown in FIG. 3. It is defined by the expression in equation 5:

$$XDEV=x-V_{in}t-(V_{out}-V_{in})t^2/2 \quad (5)$$

When t=T, the value of x=x1, the value of XDEV is called X1DEV. As shown in FIG. 7, the parameter XDEV follows curve 116 in time and converges to a desired value X1DEV=17 mm. Also, the rotation angle implied by curve 118 converges to value 0.

The parameters A and B are obtained by an iterative procedure for any combination of values of $x_1$, Δy and ΔB. FIGS. 8-19 illustrate examples of the results of such a calculation. For the sake of clarity, these results are shown on separate 3-dimensional graphs, each of which is valid for a particular value of X1DEV. FIGS. 8-13 represent the values of A as a function of Δy and Δβ. FIGS. 14-19 represent the values of B in a similar fashion.

As shown above, the parameters A and B are three-dimensional surfaces, functions of parameters $x_1$, Δy and Δβ. The values of these parameters can be stored as arrays. Alternatively, these surfaces could also be approximated as curve-fitted functions, such as quadratics. Tables of the arrays, or coefficients of the functions, may be provided to any particular machine or apparatus. For a specific value of $x_1$, Δy and Δβ, the needed values of A and B may be obtained by interpolation among the numbers in the number arrays, or by function evaluation based on the curve-fitted functions.

Figure 20:
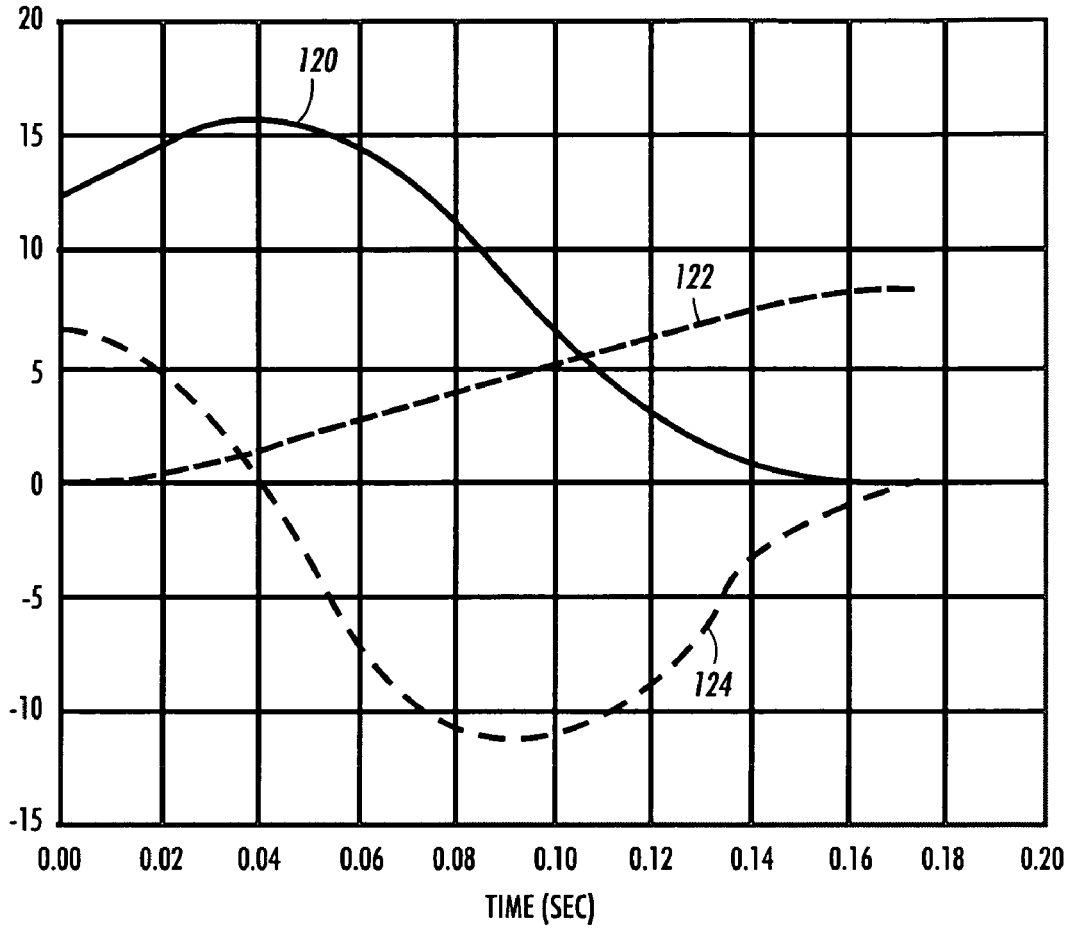
FIG. 20 illustrates convergence of velocity profile parameters.

FIG. 20 illustrates results from such an interpolation. In FIG. 20, the parameter T is set at 0.175 seconds. X1DEV is 8.5 mm, Δy is 12.5 mm, and Δβ is 0.12 radiance. The parameters A and B are obtained by double linear interpolation from a 6×6×6 table. Thereafter, a simulation of the registration process is carried out. As shown in FIG. 20, the lateral offset y represented by curve 120, and the rotation represented by curve 124 converged to 0. The parameter X1DEV, represented in curve 122, converged to the desired value of 8.5 mm.

FIGS. 21 through 28 are referred to for the discussion related to systems and methods of simulating the relative movement between the nips NA and NB and the sheet of paper 10. The simulated result may be used in improving paper sheet (medium) registration.

As discussed below, a method for medium registration may include establishing a first parameter as a function of a desired process-direction position at a specific time, a desired change of angle, and a desired change of lateral position, the first parameter representing a needed amplitude of a lateral direction move velocity trapezoid; and establishing a second parameter as a function of the needed process-direction position, the desired change of angle, and the desired change of lateral position, the second parameter representing a needed amplitude of process-direction move velocity trapezoid. In the previous sentence and the rest of this document, "process-direction" refers to the major direction of paper motion in the machine in question.

The systems and methods that are discussed in connection with FIGS. 21-28 may be based on velocity profiles that are deviations from a nominal profile. In general, a nominal profile delivers a sheet of paper from an "input registration," including information of input process, lateral and skew positions, to an "output registration," including information of input process, lateral and skew positions. The term "skew" refers to the deviation of the sheet angle from its ideal value.

Typically, but not necessarily, the nominal profile does not make corrections to lateral, skew and process-direction offsets. The sheet of paper is already registered at the input of the registration system. An example of a nominal profile is a "constant velocity nominal profile" that delivers a sheet of paper from an input to an output at a constant velocity, such as at 1.0 meter per second. Another example of a nominal profile is a "trapezoidal velocity nominal profile." When the lead-edge (LE) of a sheet of paper stops just downstream of the nips NA and NB, a nominal trapezoidal velocity profile may be executed to deliver the sheet to the output at zero velocity These two examples above may be considered extreme examples of a nominal profile. There may be a variety of nominal profiles that are applicable to the systems and methods discussed in connection with FIGS. 21 through 28.

When an arriving sheet of paper is not at a desired "input registration," a profile that differs from the nominal profile needs to be executed in order to deliver the sheet at the output with a desired "output registration." For example, the nominal profile may need to be amended by process, lateral and skew corrections, so as to yield the desired "output registration."

Figure 21:
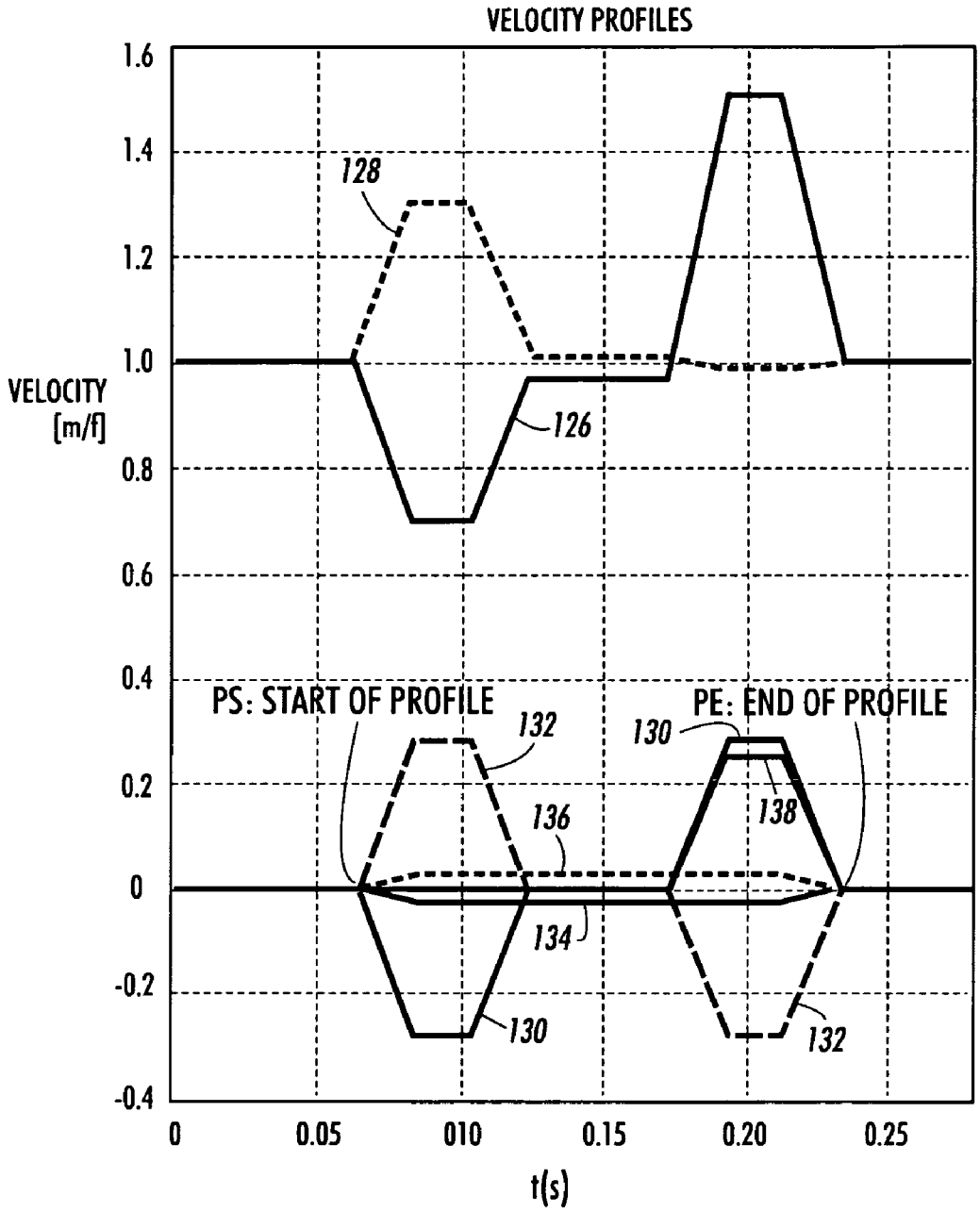
FIG. 21 illustrates composite velocity profiles that may be used in a simulation.

The difference between the executed profile and the nominal profile may be determined by simulation. FIG. 21 shows velocity profiles that may be used in a simulation. In the example shown in FIG. 21, the profile 126 represents the velocity profile of nip NA, and the profile 128 represents the velocity profile of nip NB.

In FIG. 21, the construction of velocity profiles 126 and 128 considered the four segments of functions shown in FIGS. 3 through 6. In particular, the profile 126 is a sum of the curves 130, 134 and 138. The curve 128 is a sum of 132, 136 and 138. In general, the curves begin at a start point PS, and end at an end point PE.

For example, the curve 138 represents process correction, which is a change in X-direction position. This profile is applied to both nips NA and NB, and delivers the lead edge of the sheet of paper at a target time at a desired output location.

The curve 134 is a skew correction for nip NA, and the curve 136 is a skew correction for nip NB. The differential velocity of nips NA and NB deskews the sheet. Here, the term "deskew" means elimination of skew, or angular error. The amount of deskew is the integral of the difference in velocities. For trapezoidal profiles and many other profiles, an analytical expression may be obtained for the value of the velocity difference required to deskew the sheet.

In FIG. 21, the curve 130 represents the lateral correction for nip NA, while the curve 132 represents the lateral correction for the nip NB. In a desired correction, a differential velocity between nips NA and NB is first applied to introduce a specific skew or a wag move, thereafter the sheet travels for a specific amount of time at this skew. Thereafter, another differential velocity is applied to deskew the sheet. In general, a closed-form solution cannot be found. In particular, given a magnitude of the lateral, skew and process error, the value of the differential velocity cannot be computed explicitly. Thus, a simulation, as discussed below, is beneficial.

Figure 22:
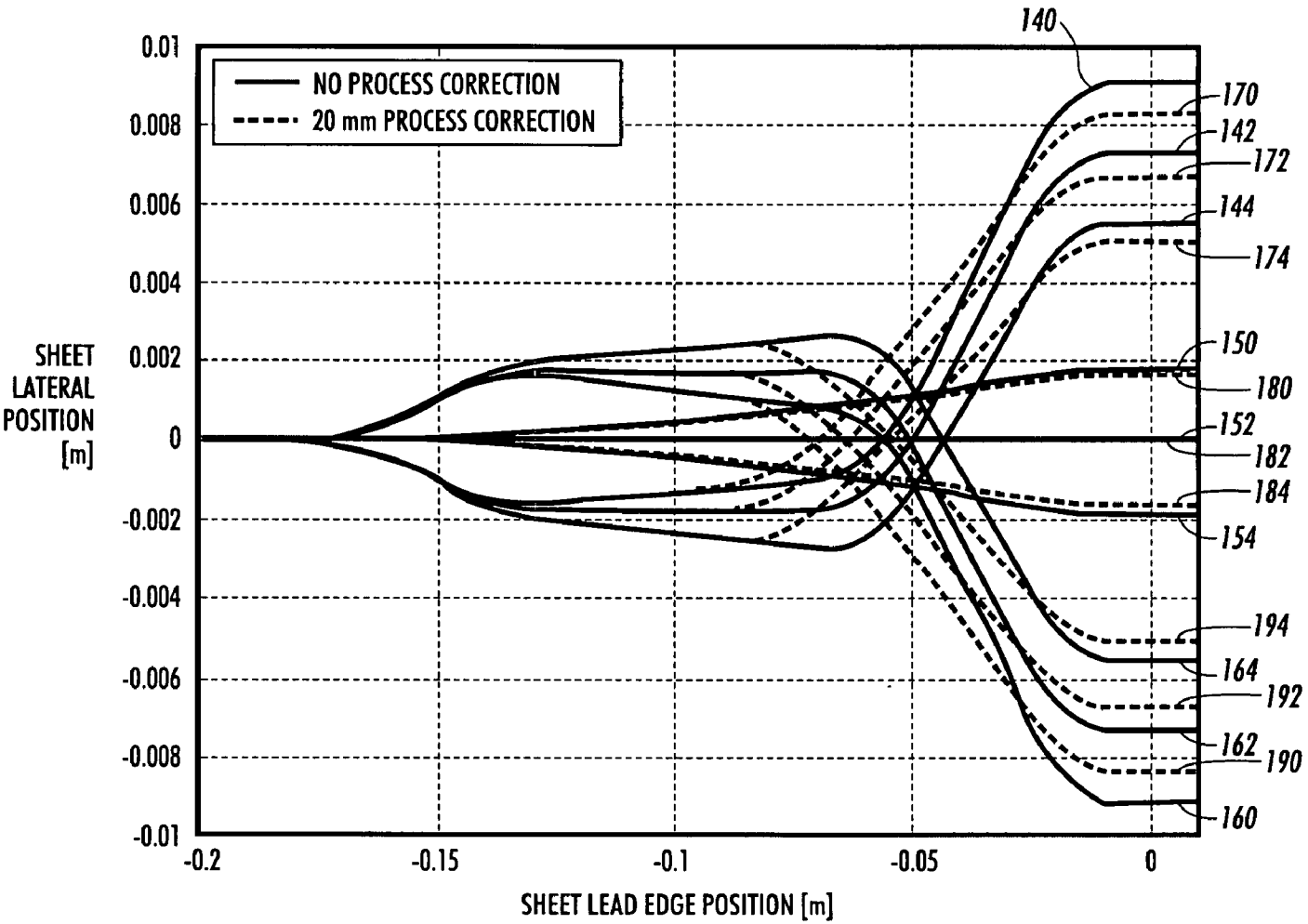
FIGS. 22 through 24 illustrate results of velocity profile simulations.
Figure 23:
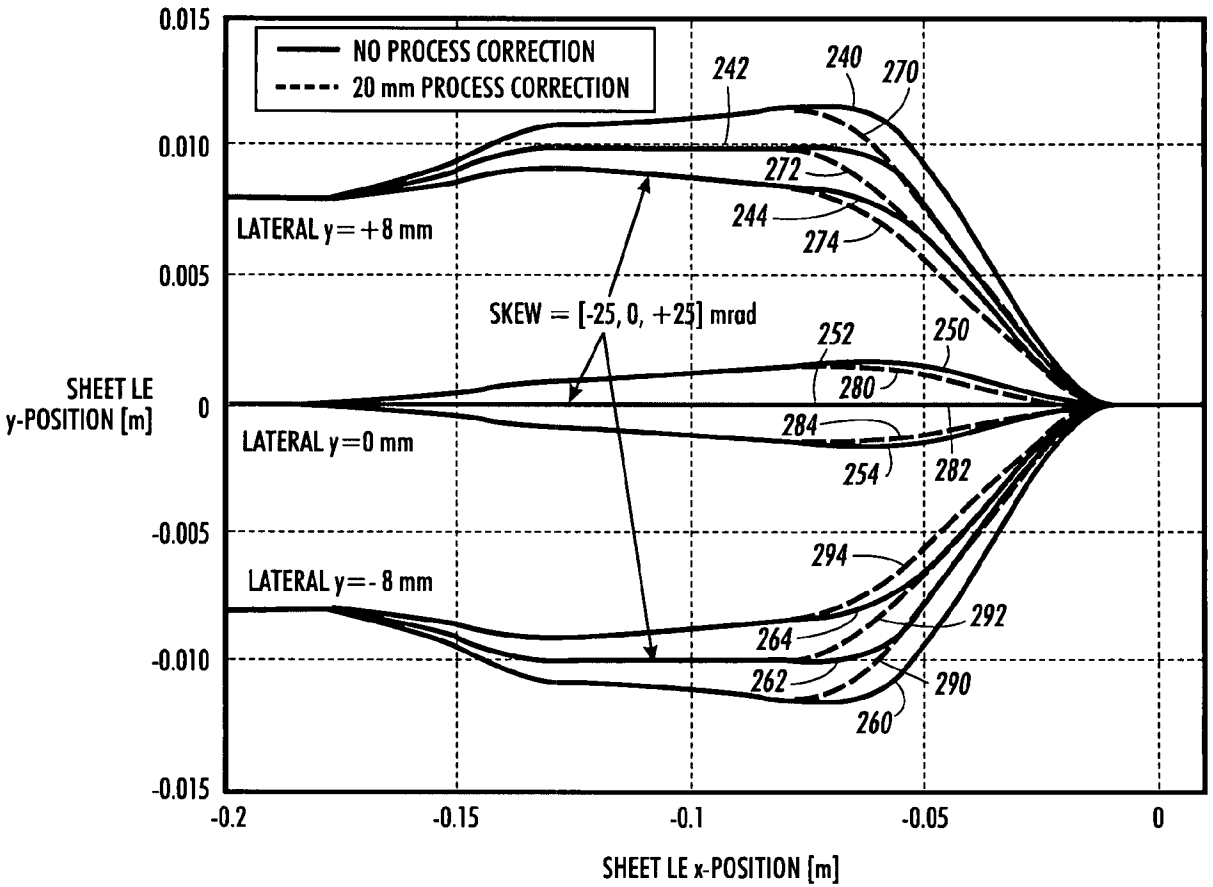
Figure 24:
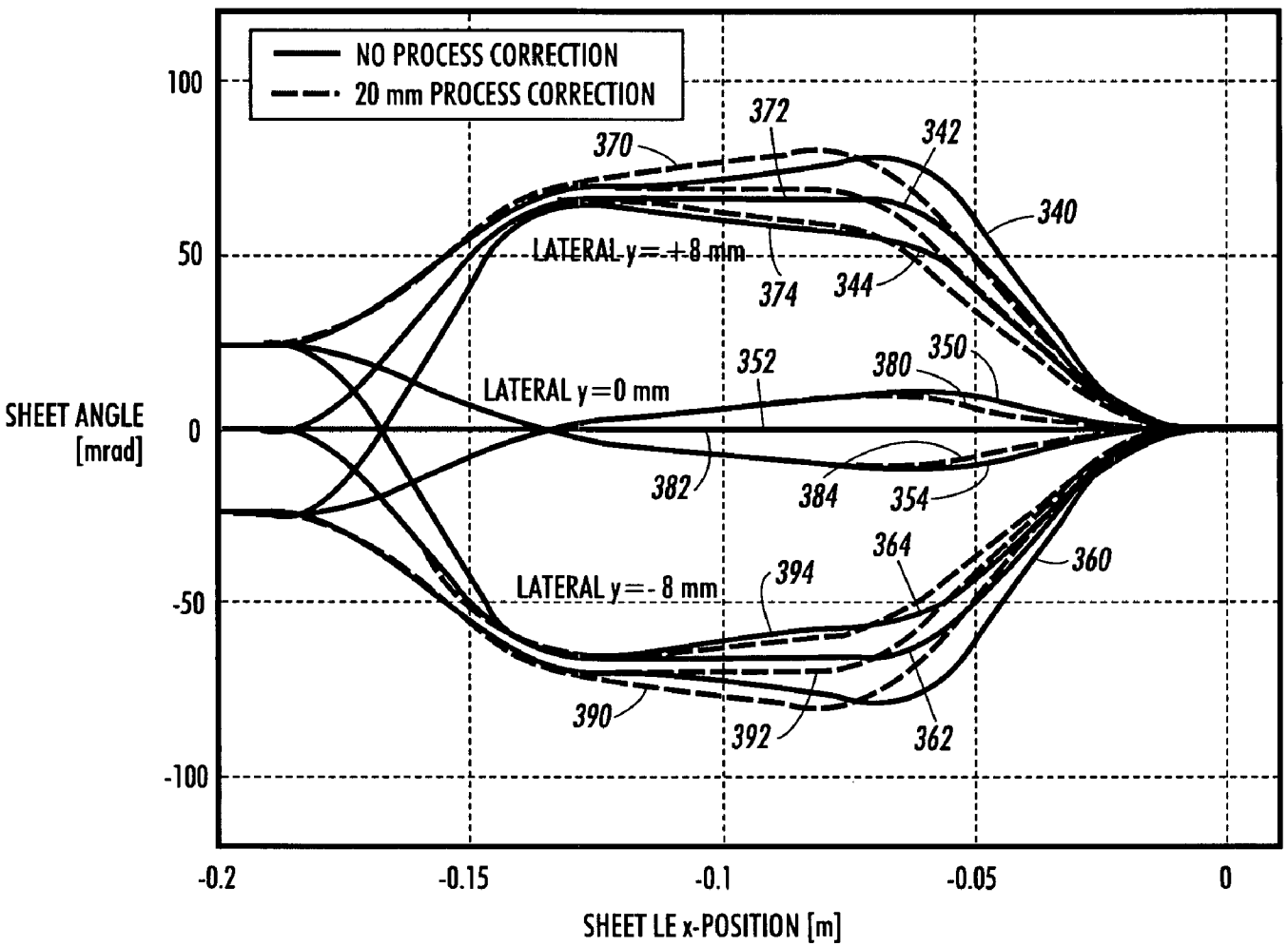

FIGS. 22 through 24 illustrate the results of a simulation associated with a constant nominal velocity profile. In this simulation, the process velocity is set at 1.0 meter per second. The synthesis of the solution includes computing the amplitudes of the velocity profiles that will correct the lateral, skew and process error.

For example, the velocity profiles 126 and 128 of FIG. 21 are computed. As discussed above, each of the velocity profiles 126 and 128 is a sum of a plurality of profiles or curves. For example, the velocity profile 126 is a sum of profiles 130, 134 and 138. As discussed above, the profile 138 is for both nip NA and nip NB. Profiles 130 and 134 are for nip NA only.

A simulation may be used to compute profiles 126 and 128. Equations 1 through 4 may be used.

In an example discussed below, 18 simulations were performed. In each simulation, the amplitude of skew correction was calculated based on input skew measurements. The amplitude of the process correction was calculated based on the required process correction. In addition, an amplitude of the lateral trapezoidal curve 130 or 132 were selected, and the lateral move was determined.

The 18 simulations cover a combination of inputs. In particular, the inputs include three skew values: −20 mrad, 0 mrad, and 20 mrad. Here the unit mrad means milliradians, or the one-thousandth part of a radian. Radia is the angle that subtends a length of arc equal to the radius. The inputs also include three amplitudes for the lateral velocity trapezoids: −0.2, 0, and 0.2 meters per second. In addition, the inputs include two values for the process correction: 0 and 0.002 meters.

The 18 simulations produced 18 results that constitute an 18 element vector $y_m$, as shown in FIG. 22. In particular, FIG. 22 shows a plot of the lateral position of a sheet of paper as a function of the lead-edge position of the sheet, when the velocity profiles 126 and 128 are executed. For example, curves 140, 142 and 144 represent the simulated results under the input of no process correction and a 0.2 mm per second amplitude of the lateral trapezoids, with a skew value of 20 mrad, 0 mrad, and −20 mrad, respectively. Curves 150, 152 and 154 represent the simulated result for 0 process correction and 0 lateral trapezoids amplitude, and for a skew value of −20 mrad, 0 mrad, and 20 mrad, respectively. Curves 160, 162 and 164 represent simulated results of no process correction and a −0.2 lateral trapezoids amplitude, and for a skew value of 20 mrad, 0 mrad, and −20 mrad, respectively.

Curves 170, 172 and 174 indicate the simulated results for a 20 mm process correction and a 0.2 meter per second of lateral trapezoids amplitudes, and for a skew value of 20 mrad, 0 mrad and −20 mrad, respectively. Curves 180, 182 and 184 indicate the simulated results for a 20 mm process correction and a 0.2 lateral trapezoid amplitude, and for a skew value of −20 mrad, 0, and 20 mrad, respectively. Curves 190, 192 and 194 indicate the simulated results for a 20 mm process correction and a −0.2 lateral trapezoids amplitude, and for a skew value of 20 mrad, 0 mrad and −20 mrad, respectively.

In general, FIG. 22 indicates how a sheet of paper would deviate from a nominal profile when different errors are introduced.

The 18 element vectors $y_m$ may be used in a regression algorithm. In the above-discussed simulation, a multiple linear regression of the form:

$$y=a_1+a_2\beta+a_3V+a_4W \tag{6}$$

was used. The regression algorithm determined the coefficients $a_1$–$a_4$ of the multivariate model that fit, based on least squares, the lateral move $y_m$ to the input values of skew β, the lateral amplitude V, and the process correction vector W. The simulation minimizes the least square error. In particular, the simulation minimizes the distance between the model prediction y and measured $y_m$.

The coefficients $a_1$ and $a_4$ appeared to be approximately equal to 0 and were subsequently set to 0. It is noted that the fact that $a_4$ was approximately 0 does not necessarily mean that the output lateral y is not sensitive to variation in W. The fact that $a_4$ was approximately 0 merely means that the multivariate linear model does not adequately describe the relation as illustrated in FIG. 22. Thus, a non-zero value for W is reflected in the final form of the relation, as discussed in greater detail below.

For W=0, the amplitude V of the lateral move may be determined from the measured input lateral $y_m$ and the measured input skew arrow $\beta_m$ according to:

$$V=\frac{-y_m-a_2c_m}{a_3} \tag{7}$$

Equation 7 indicates a negative coefficient for $y_m$. A negative lateral measurement requires a positive lateral move.

As shown in FIG. 22, the effect of process correction is the difference between a pair of curves, such as, for example, curves 140 and 170. Curve 140 indicates a lateral $Y_0$ associated with no process correction. Curve 170, on the other hand, indicates a lateral $Y_w$ as a result of a process correction of 0.002 meters. The gain K may be determined as:

$$K=\frac{\frac{Y_w}{Y_0}-1}{W} \tag{8}$$

For the 9 simulations based on 0 process correction, the average K was determined to be K=−4.12 [1/m] with a standard deviation of 0.12.

In view of equation 8, a correction to equation 7 is added to the input lateral measurement $y_m$:

$$V=\frac{-(-K*W)y_m-a_2c_m}{a_3} \tag{9}$$

Equation 9 may be used in a registration process to correct detected errors, such as skew, lateral amplitude or process arrows. Such a correction may be simulated.

FIGS. 23 and 24 show the results of registration simulations that correct detected errors. In particular, FIG. 23 shows the lateral position or amplitude as a function of the lead-edge position of a sheet of paper. FIG. 24 shows the skew as a function of the lead-edge position. The parameters used in the simulations include skew values of −25, 0 and 25 mrad, lateral amplitude value of −8, 0 and 8 mm, and process correction value of 0 and 20 mm.

In particular, in FIG. 23, curves 240, 242 and 244 represent the simulated result for a 0 process correction and an 8 mm lateral amplitude, and for skew values −25, 0, and 25 mrad, respectively. Curves 250, 252 and 254 represent the simulated result for 0 process correction and 0 lateral amplitude, and for skew values of −25, 0 and 25 mrad, respectively. FIGS. 260, 262 and 264 represent simulated result for 0 process correction and −8 mm lateral amplitude, and for skew values of −25, 0, and 25 mrad, respectively.

In FIG. 23, curves 270, 272 and 274 represent simulated result for 20 mm process correction and 8 millimeter lateral amplitude, and for skew values −25, 0 and 25 mrad, respectively. Curves 280, 282 and 284 represent simulated result for 20 mm process correction and 0 lateral amplitude, and for skew values of −25, 0 and 25 mrad, respectively. Curves 290, 292 and 294 represent simulated result for 20 mm process correction and −8 mm lateral amplitude, and for skew values of −25, 0 and 25 mrad, respectfully.

In FIG. 24, curves 340, 342 and 344 represent simulated result for a 0 process correction and 8 mm lateral amplitude, and for skew values of −25, 0 and 25 mrad, respectively. Curves 350, 352 and 354 represent simulated result for 0 process correction and 0 lateral amplitude, and for skew values of −25, 0 and 25, respectively. Curves 360, 362 and 364 represent simulated result for 0 process correction and −8 mm lateral amplitude, and for skew values of −25, 0 and 25 mrad, respectively.

As shown in FIG. 24, curves 370, 372 and 374 represent simulated result for 20 mm process correction and 8 millimeter lateral amplitude, and for skew values of −25, 0 and 25, respectively. Curves 380, 382 and 384 represent simulated result for 20 mm process correction and 0 lateral amplitude, and for skew values of −25, 0 and 25 mrad, respectively. Curves 390, 392 and 394 represent simulated result for 20 mm process correction and −8 mm lateral amplitude, and for skew values of −25, 0 and 25 mrad, respectfully.

As shown in FIGS. 23 and 24, both skew and lateral registration errors may be reduced to a value very close to 0 after a registration move is completed.

Under certain conditions, a trapezoidal velocity profile may be needed. For example, in some registration schemes, a first sheet of paper may be delivered early to the registration nips. Such an early delivery may be associated with the intention that a second sheet of paper will catch up with the first sheet of paper, and that both sheets get delivered to an image hand-off station with a small inter-sheet gap. In this case, the first sheet may come to a stop at a location that is a short distance past the center-line of the registration nips. At a certain time, before an image arrives at a target position to be recorded on the sheets, for example, the registration nips must start executing a velocity profile for the sheets to make the appointment with the image. Sometimes, it is required that the sheets and the image come to a stop at the hand-off location, such as a location at which the sheets and the image engage a transfer nip. Thus, under such conditions, a trapezoidal velocity nominal profile may be used.

Figure 25:
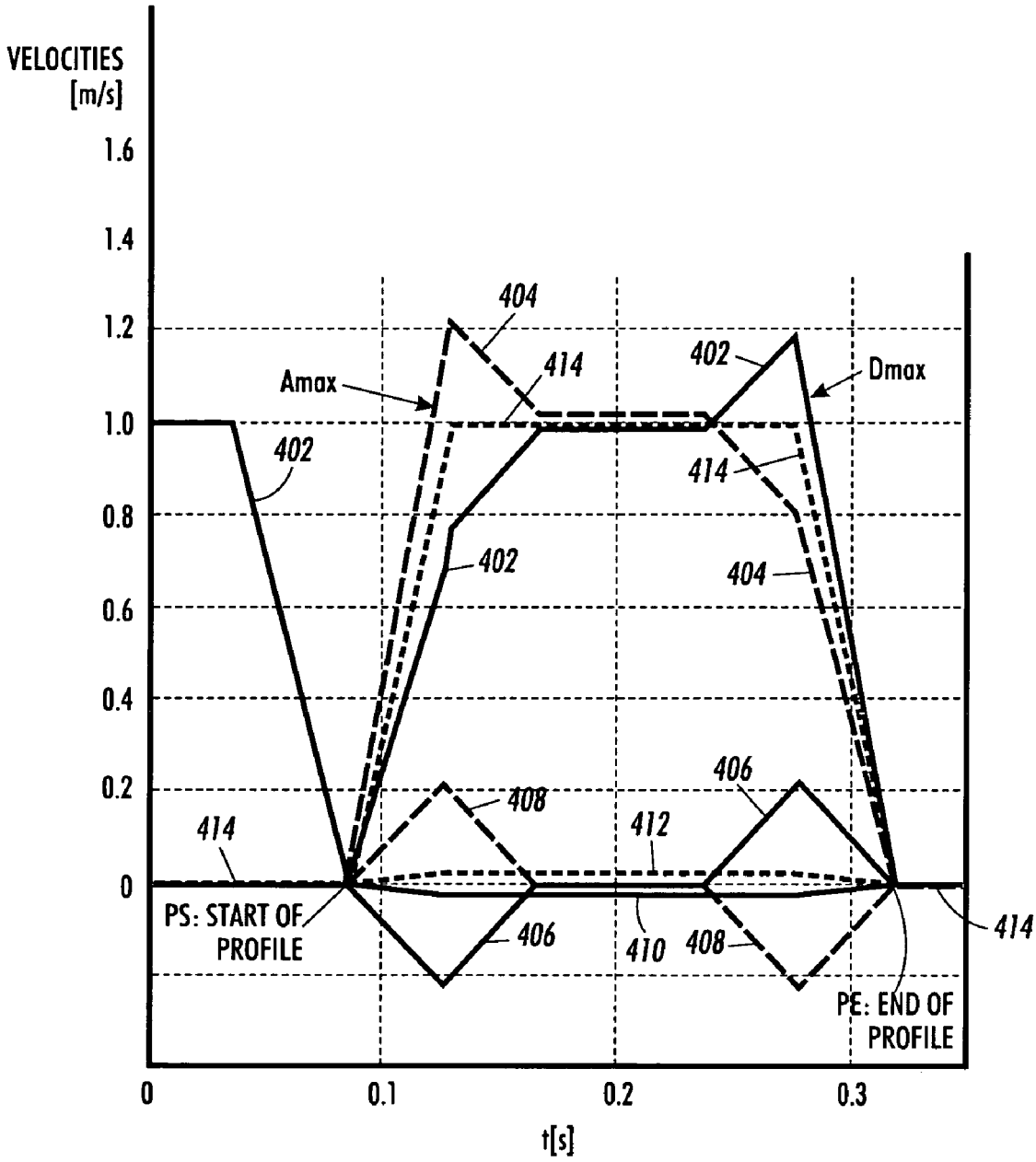
FIG. 25 illustrates composite velocity profiles that may be used in simulations of velocity profiles.

FIG. 25 illustrates an exemplary trapezoidal nominal velocity profile. As shown in FIG. 25, curves 402 and 404 represent the desired velocity profiles VA and VB for nips NA and NB, respectfully. Curves 406 and 408 represent lateral correction for VA and VB, respectively. Curves 410 and 412 represent skew correction for VA and VB, respectively. Curve 414 represents process correction for both VA and VB.

Similar to curves 126 and 128 in FIG. 21, curves 402 and 404 are each a sum of a number of curves. In particular, curve 402 is a sum of curves 406, 410 and 414. Curve 404 is a sum of curves 408, 412 and 414. As shown in FIG. 25, curve 404 may undergo a maximum acceleration Amax shortly after the start point ps of the profiles. The curve 402 may undergo a maximum deceleration Dmax shortly before the end point PE of the profiles. The value of the maximum acceleration Amax may be about 3 G, where G represents the acceleration of gravity, which is approximately equal to 9.8 m/s$^2$. The value of the maximum deceleration Dmax may be −3 G.

Figure 26:
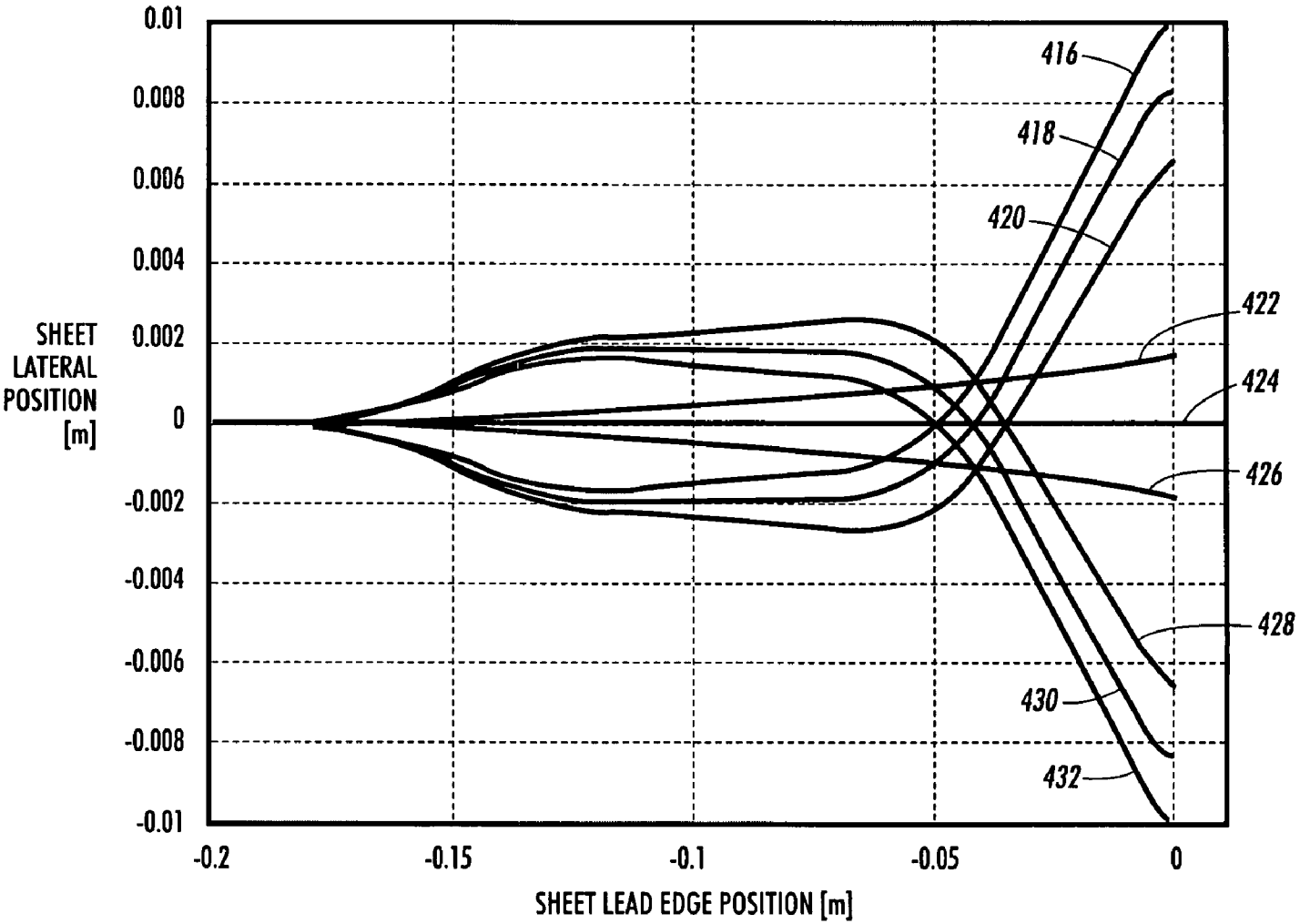
FIGS. 26 through 28 illustrate results of velocity profile simulations.

Simulations may be performed to illustrate how a sheet of paper would deviate from a trapezoidal nominal velocity profile when a variety of errors is introduced. FIG. 26 shows the result of nine simulations. In particular, FIG. 26 shows lateral y direction move as a function of lateral trapezoidal amplitude, process correction and input skew. As shown in FIG. 26, curves 416, 418 and 420 represent simulated result for 0.2 lateral amplitude, and for skew values of 20, 0 and −20 mrad, respectively. Curves 422, 424 and 426 represent simulated results for 0 lateral amplitude, and for skew values of −20, 0 and 20 mrad, respectively. Curves 428, 430 and 432 represent simulated results for −0.2 lateral amplitude, and for skew values of −20, 0 and 20 mrad, respectively.

Figure 27:
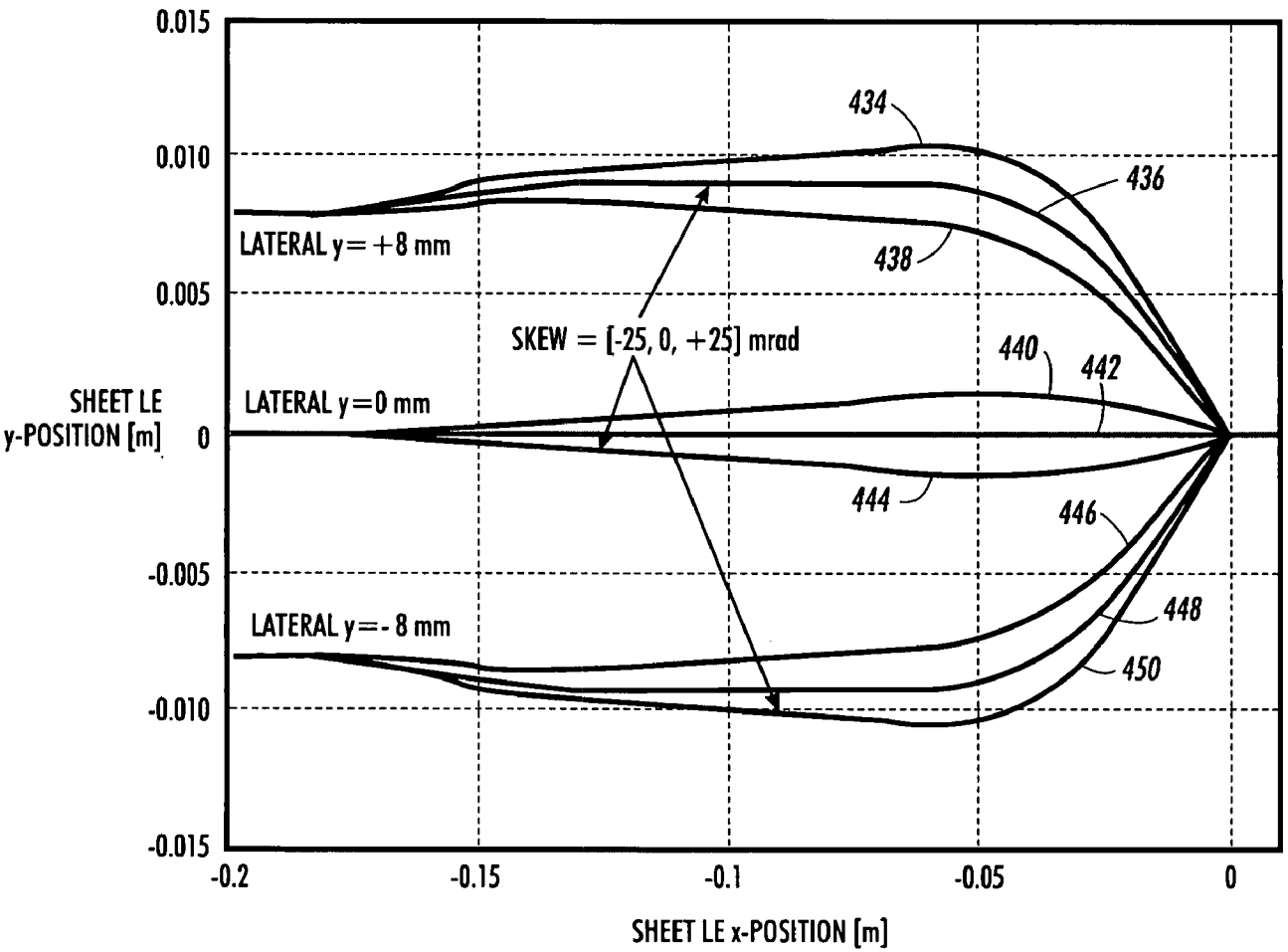
Figure 28:
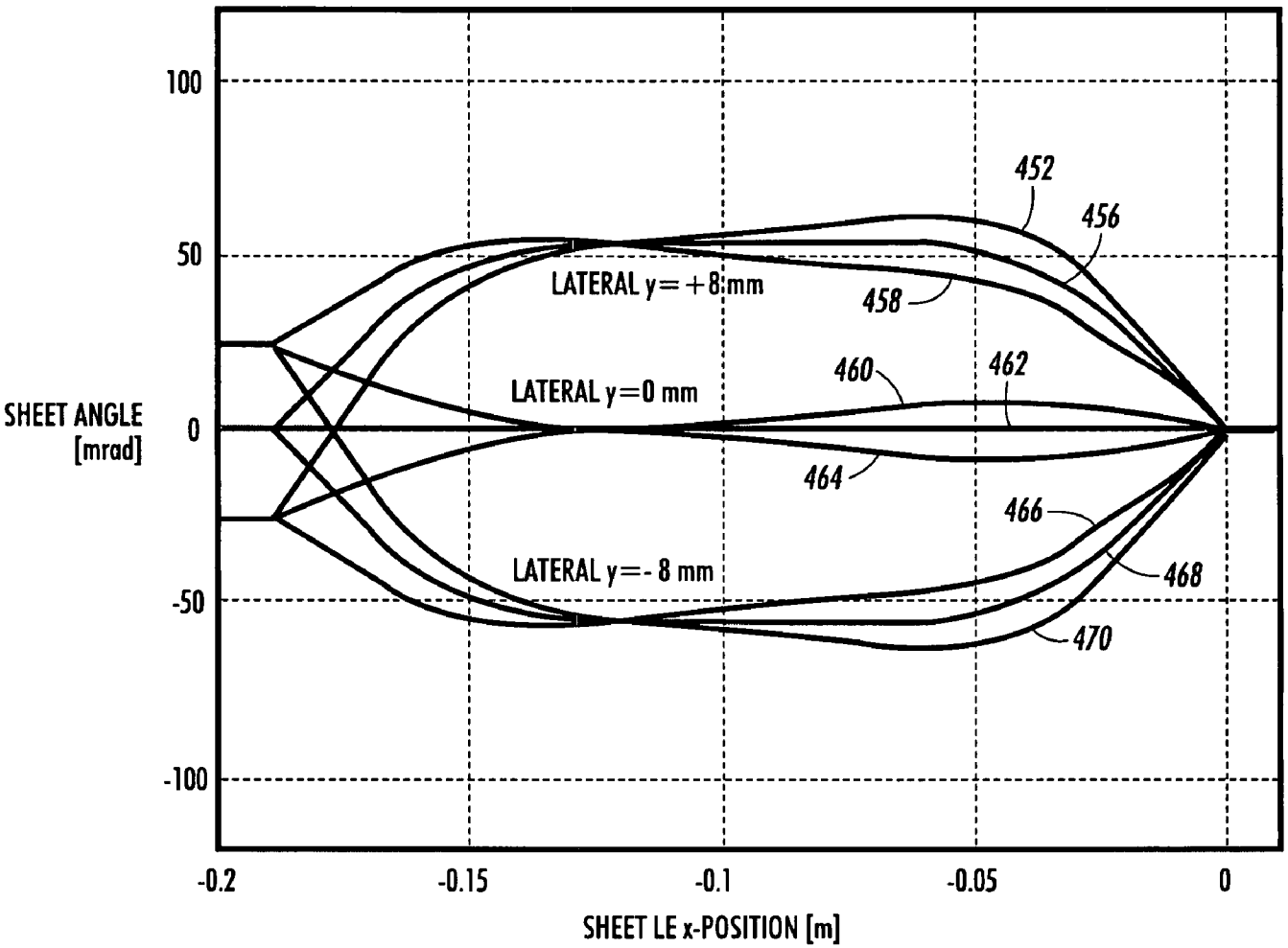

The simulated result in FIG. 26 may be used in a regression algorithm that may be used to evaluate parameters needed in correcting errors in registration. This procedure is termed "calibration" of the correction process. Simulations may be performed to show the performance of the registration correction. FIGS. 27 and 28 show results of such a simulated registration correction. In particular, FIG. 27 shows the lateral position of a sheet of paper as a function of the lead-edge position of the sheet of paper. FIG. 28 illustrates skew corrections as a function of the lead-edge position and for several lateral errors.

As shown in FIG. 27, curves 434, 436 and 438 represent simulated correction results for lateral offset of 8 mm, and for skew values of −25, 0 and 25 mrad, respectively. Curves 440, 442 and 444 represent simulated correction results for 0 lateral offset, and for skew values of −25, 0 and 25 mrad, respectively. Curves 446, 448 and 450 represent simulated correction results for lateral offset of −8 mm, and for skew values of −25, 0 and 25 mrad, respectively.

In FIG. 28, curves 452, 456 and 458 represent simulated correction results for lateral offset of 8 mm, and for skew values of −25, 0 and 25 mrad, respectively. Curves 460, 462 and 464 represent simulated correction results for 0 lateral offset, and for skew values of −25, 0 and 25 mrad, respectively. Curves 466, 468 and 470 represent simulated correction results for lateral offset of −8 mm, and for skew values of −25, 0 and 25 mrad, respectively.

In general, as shown in FIGS. 27 and 28, the skew and lateral registration errors may be reduced to a value very close to 0 after the registration move is completed.

As discussed above, velocity profiles for registration may be generated. A predetermined set of profiles of particular forms may be used for process, lateral and skew correction. These profiles may contain parameters that may be adjusted to fit particular cases. Calibration of the parameters contained in the profiles may be performed by simulation of the motion of a sheet of paper. Regression analysis may be used on the simulation output to curve-fit the results to a model. The model may be used to determine the parameters contained in the pre-determined set of profiles.

After calibration, a sequence of registration profile calculation may be divided into a plurality of steps. Before sheet registration commences, measurements may be taken for lateral and skew errors, for process position, and for determining process correction. Thereafter, determination may be made regarding trapezoidal amplitude for a skew correction, trapezoidal amplitude for a process correction, and trapezoidal amplitude for lateral correction. The trapezoidal amplitude for skew correction and the trapezoidal amplitude for process correction may be determined in closed form. The trapezoidal amplitude for lateral correction may be determined based on equations 6 through 9.

A registration system may use an open-loop path velocity profile for process direction correction. For example, a required profile to deliver a sheet of paper at a correct time may be calculated as soon as the sheet of paper enters a registration device. The profile may then be executed.

However, as shown in equations 1 and 2, the profiles for velocity V and angular velocity ω are generally functions of time. Thus, when it is desired or necessary to change a path velocity profile, the path on the sheet of paper will deviate from an intended path, resulting in paper registration errors. In particular, profiles for velocity V and angular velocity ω that use a time base as a reference will generate different paths for different process direction velocities, resulting in a different registration at the output.

Examples of variable path velocities may be found in situations where a first sheet of paper has a trapezoidal velocity profile, and the second sheet of paper has a constant velocity nominal profile. Also, there are situations where the second sheet must execute a process velocity hitch towards the end of the move. These situations may be needed to decrease the size of an inter-document gap while still registering the second sheet. Additionally, many registration systems have a lead-edge sensor before the hand-off point for last minute process direction correction. A process direction velocity hitch may be executed based on the timing information from the sensor. A "hitch" here indicated a brief correction of the process trajectory of a sheet of paper so that it is more advanced or delayed than where it would have been without the hitch. Finally, in some cases, especially in cases involving downstream media jams or congestion in a system, a sheet of paper may need to come to a full stop.

As discussed above, a nominal path may be generated by prescribing a path velocity V. Similarly, a nominal angular velocity ω may be generated. The path may be chosen to correct for a certain input registration error. In developing a nominal path for a particular application, a reference path velocity V may be used for a registration distance. The reference velocity may be a constant velocity. A nominal angular velocity may be determined and used, together with the reference velocity, to prescribe a path on the sheet of paper.

It may be desirable to have velocity-independent paths. For example, it may be desirable to construct an angular velocity ω as a function of the coordinate s along the path. For example, when the reference velocity is constant and equal to unity, then a nominal s may be expressed as $$s_{nom}(t)=t \tag{10}$$

Accordingly, the nominal angular velocity may be expressed:

$$\omega_{nom}(s)=\omega_{nom}(t). \tag{11}$$

When the reference velocity is a constant $V_c$, but not equal to unity, the corresponding angular velocity ω may be expressed as:

$$\omega_c(s)=\omega_{nom}(s)*V_c \tag{12}$$

When the reference velocity is a variable V(t), the angular velocity W(s) may be expressed as:

$$\omega(s)=\omega_{nom}(s)*V(t) \tag{13}$$

The equations associated with non-constant reference velocity may be solved numerically.

In view of the above, an angular velocity profile ω(s) may be obtained as a function of coordinate s along the path. In order to follow the same path for different path velocities V(t), the position s along a path may need to be determined. This determination may be based on the integration of the equations discussed above. In real time control, this determination may mean adding a Δs=V(t)×Δt to and approximating the integration by performing a cumulative sum of many small intervals. Also, it may be necessary to fetch the value of $\omega_{nom}$ (s) and multiply this value by the instantaneous velocity V(t) to obtain ω(s). Furthermore, it may be necessary to calculate VA and VB by solving equations 1 and 2.

Thus, a path may be determined that is independent of velocity. Accordingly, when such a path is used, different process direction velocities will not result in a different registration at the output.

As discussed above, registration with lateral and skew corrections may be achieved through a single set of differentially rotating rollers, such as nips NA and NB. A closed form solution to nip velocity trajectory may be developed that is valid for constant process direction velocity. A closed form solution is advantageous because changes may be made and analyzed without recalculating coefficients. Also, a closed form solution may be simpler to implement in software.

However, the closed form solution may be inaccurate in lateral correction with variable process direction velocity. Thus, with variable process direction velocity, corrections may be required to the closed form solution. A trapezoidal differential velocity profile may be used. When the process direction velocity does not change drastically, a "fudge factor" may be efficient for such corrections. Such fudge factors may be inserted in the closed form solution with a constant process velocity to generate a solution for variable process velocity cases.

Figure 29:
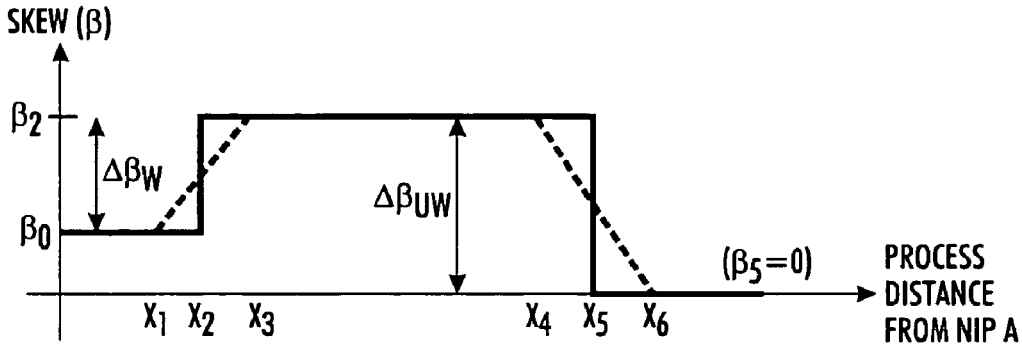
FIG. 29 illustrates a skew profile in a wagging and unwagging process.

FIGS. 29 through 37 are referred to in connection with the discussion of a constant process velocity solution. In particular, FIG. 29 illustrates a wagging and unwagging process when the process direction velocity is constant. The "wag" and "unwag" angle changes may be considered as occurring around a fixed center of rotation. Such a consideration may refer to the situation where a sheet of paper stops in the process direction for the wag and unwag motions. This consideration may yield an accurate result in the case of constant process direction velocity, as long as the wag and unwag are considered as occurring at the average process direction distance.

As shown in FIG. 29, a wag angle change $\Delta\beta_w$ induces skew that may allow lateral correction to be completed with an unwag angle change $\Delta\beta_{UW}$. The unwag angle change may be equivalent to the wag angle change plus a correction for initial skew $\beta_0$.

As shown in FIG. 29, the y-position of the sheet of paper changes at different x-positions $x_1$-$x_6$. When skew angles are small, the y offset $y_5$ at x-position $x_5$ may be expressed as:

$$Y_5=y_0+x_2*(\beta_2-\beta_0)+x_5*(\beta_5-\beta_2) \tag{14}$$

where $y_0$ represents initial lateral misregistration, $\beta_0$ represents initial skew, $y_5$ represents final lateral misregistration, and $\beta_5$ represents final skew.

Under the requirement that the final lateral misregistration $y_5$ and the final skew $\beta_5$ be zero, equation 14 leads to:

$$0=y_0+x_2*(\beta_2-\beta_0)+x_5*(0-\beta_2) \tag{15}$$

thus, $$\beta_2=(y_0-x_2*\beta_0)/(x_5-x_2) \tag{16}$$

The wag and unwag angular changes may be respectively expressed as:

$$\Delta\beta_w=\beta_2-\beta_0 \tag{17}$$

$$\Delta\beta_{UW}=\beta_5-\beta_2=-\beta_2 \tag{18}$$

Thus, the wag and unwag angular changes may be solved as:

$$\Delta\beta_w=(y_0-x_5*\beta_0)/(x_5-x_2) \quad (19)$$

$$\Delta\beta_{UW}=(x_2*\beta_0-y_0)/(x_5-x_2) \quad (20)$$

The wag and unwag moves occur over the space of Δx, where:

$$x_1=x_2-\beta x/2,\ x_3=x_2+\Delta x/2,\ x_4=x_5-\Delta x/2,\ x_6=x_5+\Delta x/2 \quad (21)$$

Figure 30:
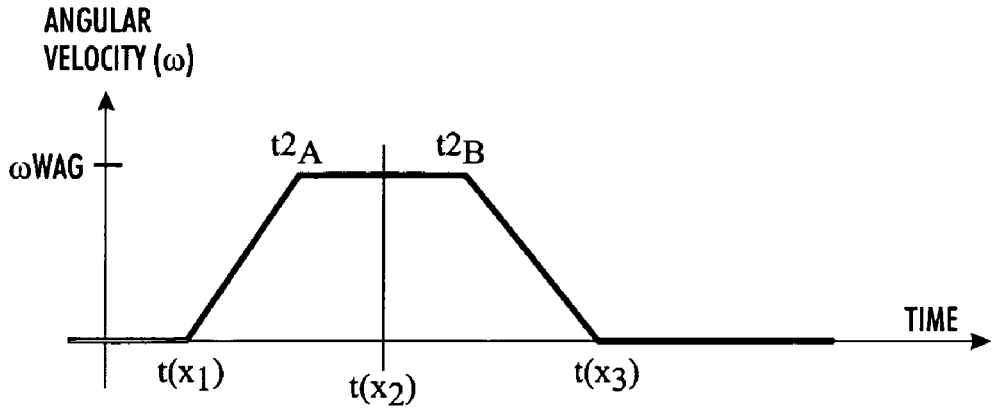
FIGS. 30 and 31 illustrate an angular velocity profile in a wagging process and an unwagging process, respectively.

A trapezoidal differential velocity profile may be used to achieve desired wag and unwag angles. The trapezoidal profile may be advantageous in minimizing angular velocities as well as maximizing wag angles. FIG. 30 illustrates a trapezoidal differential velocity profile with equal magnitudes of acceleration and deceleration. In FIG. 30, a ramp ratio R may be defined as:

$$R=(t_{2B}-t_{2A})/[t(x_3)-t(x_1)] \quad (22)$$

When the ramp ratio R is 0, the profile is a triangular profile. When the ramp ratio R equals 1, the profile becomes a square profile. Accordingly:

$$\Delta\beta_W=\omega_{WAG}*[t(x_3)-t(x_1)]*(1+R)/2 \quad (23)$$

$$\omega_{WAG}=2*\Delta\beta_W/\{[t(x_3)-t(x_1)]*(1+R)\} \quad (24)$$

Figure 31:
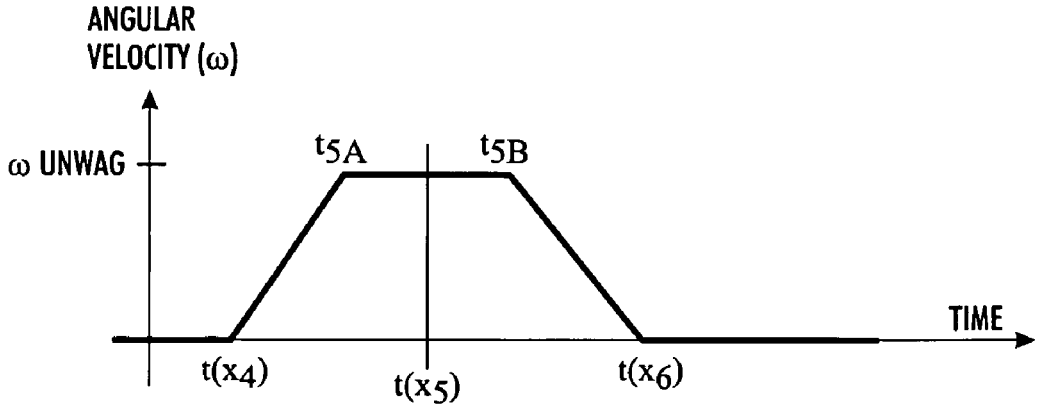

Similarly, as shown in FIG. 31:

$$\omega_{WAG}=2*\Delta\beta_{UW}/\{[t(x_6)-t(x_4)]*(1+R)\} \quad (25)$$

Also:

$$t_{2B}=t(x_3)-[t(x_3)-t(x_1)]*(1-R)/2 \text{ and}$$

$$t_{5B}=t(x_6)-[t(x_6)-t(x_4)]*(1-R)/2 \quad (26)$$

Figure 32:
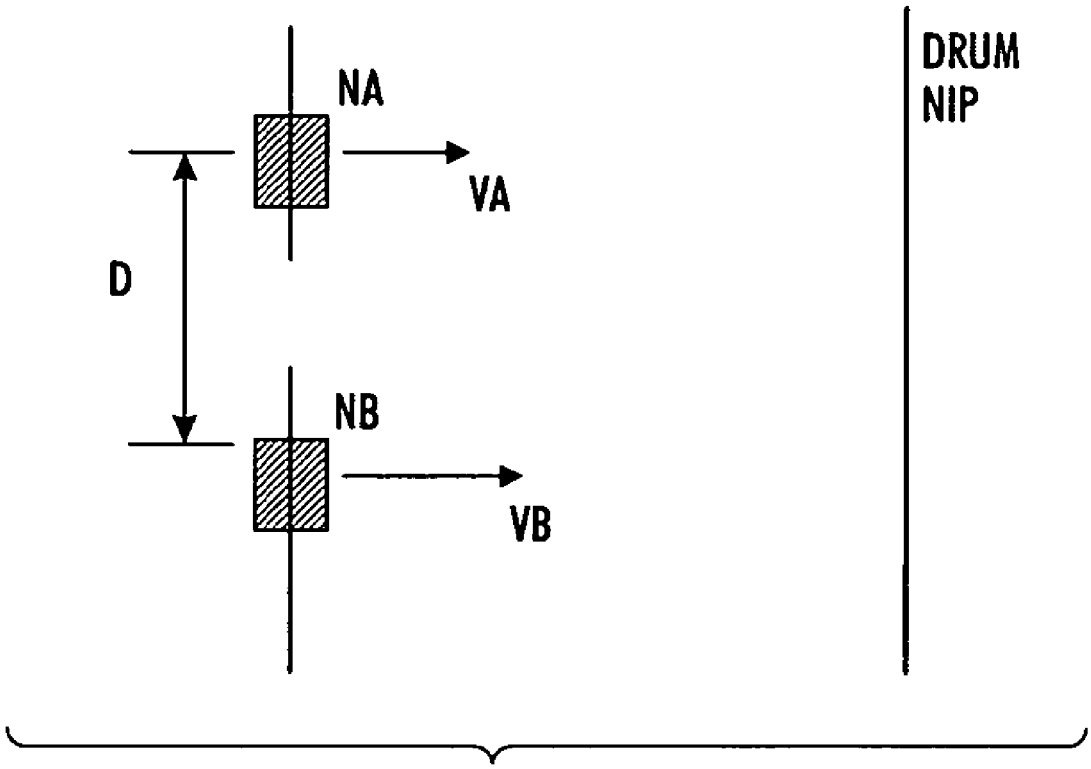
FIG. 32 illustrates a pair of nips in a medium registration system that may be used in a wagging and unwagging process.

Angular velocity ω(t) may be converted into differential velocities at nips NA and NB, as shown in FIG. 32. A differential nip velocity Δv(t) to be superimposed onto average process velocity $v_p(t)$ may be expressed as:

$$\Delta v(t)=\omega(t)*D/2 \quad (27)$$

where D represents the distance between nips NA and NB.

Therefore:

$$V_A(t)=V_P(t)+\omega(t)*D/2 \quad (28)$$

$$V_B(t)=V_P(t)-\omega(t)*D/2 \quad (29)$$

Figure 33:
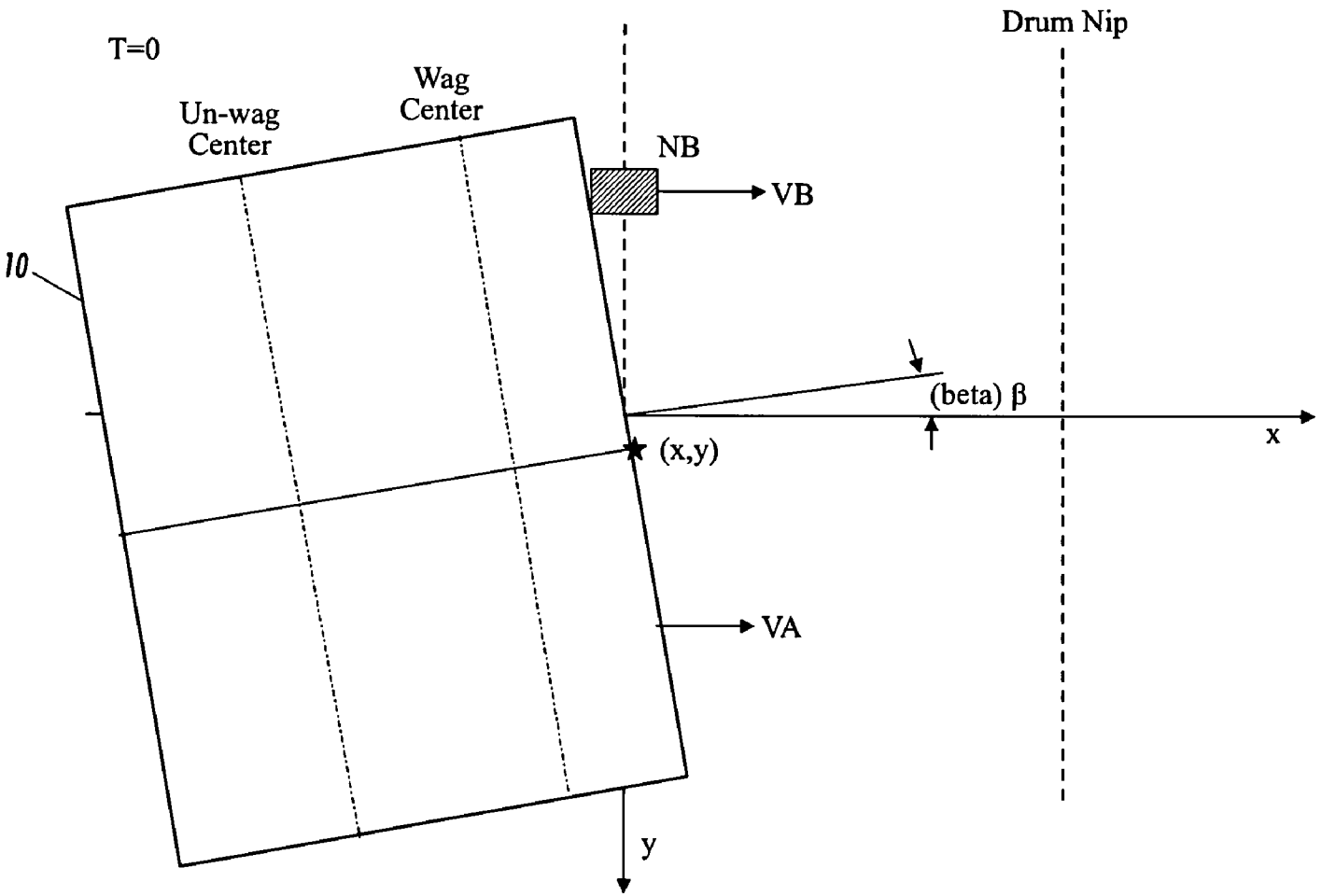
FIGS. 33 through 37 illustrate steps of a wagging and unwagging process.
Figure 34:
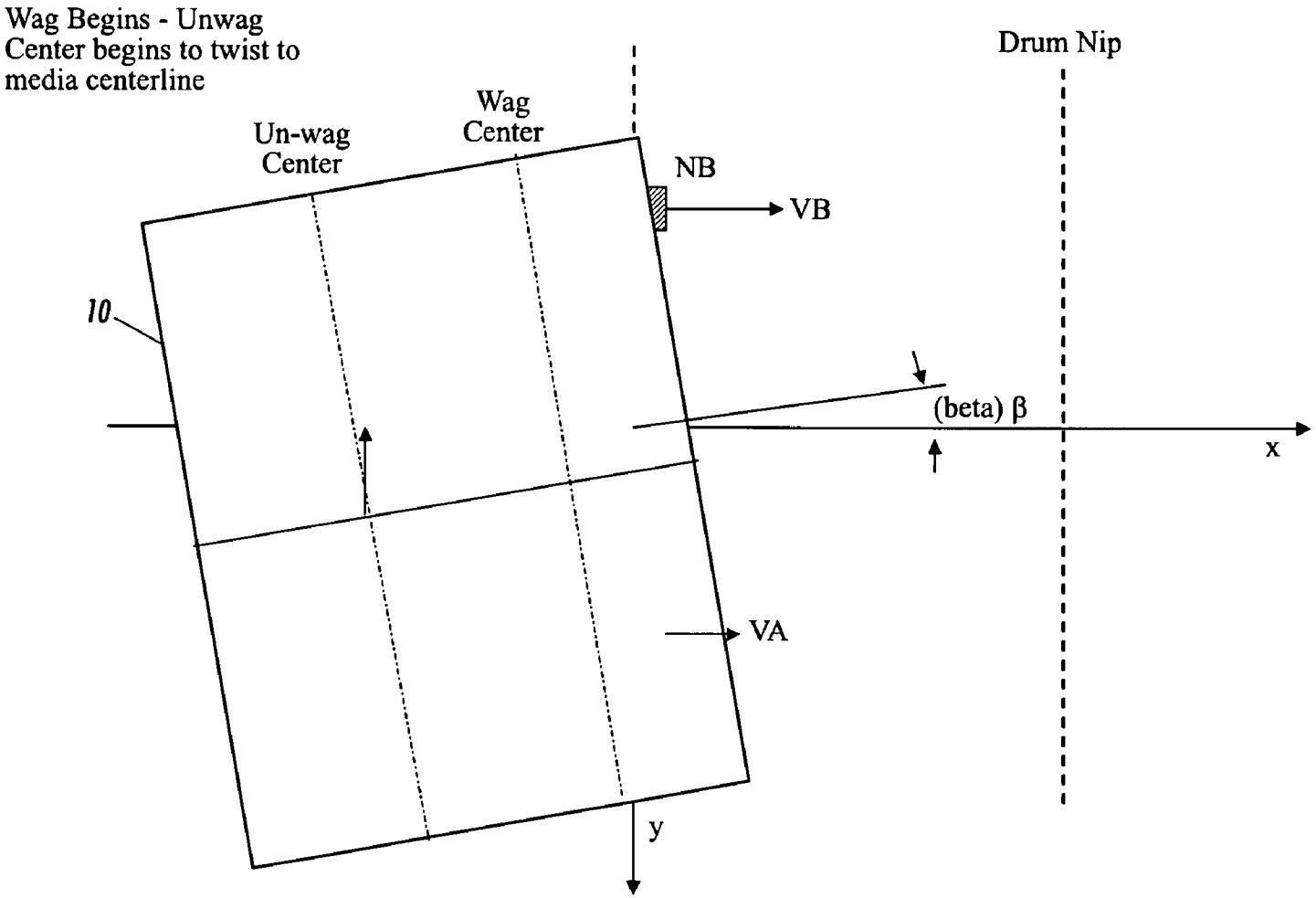
Figure 35:
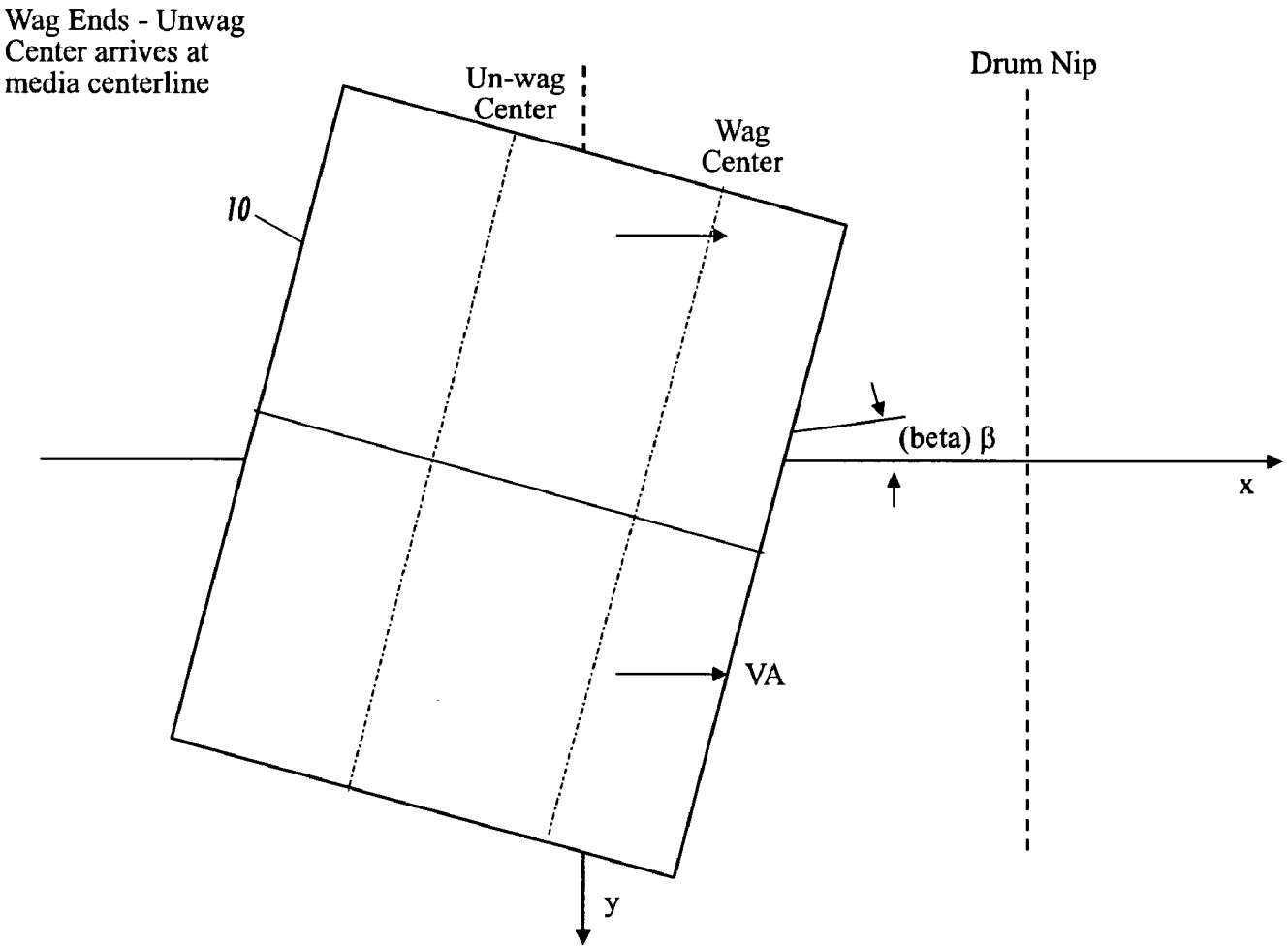

FIGS. 33 through 37 illustrate an exemplary process for wagging and unwagging a sheet of paper. As shown in FIG. 33, a sheet of paper arrives at nips NA and NB at time equals 0. In FIG. 34, wag begins. In particular, the unwag center begins to move toward the media center line. In FIG. 35, wag ends. The, unwag center arrives at media center line.

Figure 36:
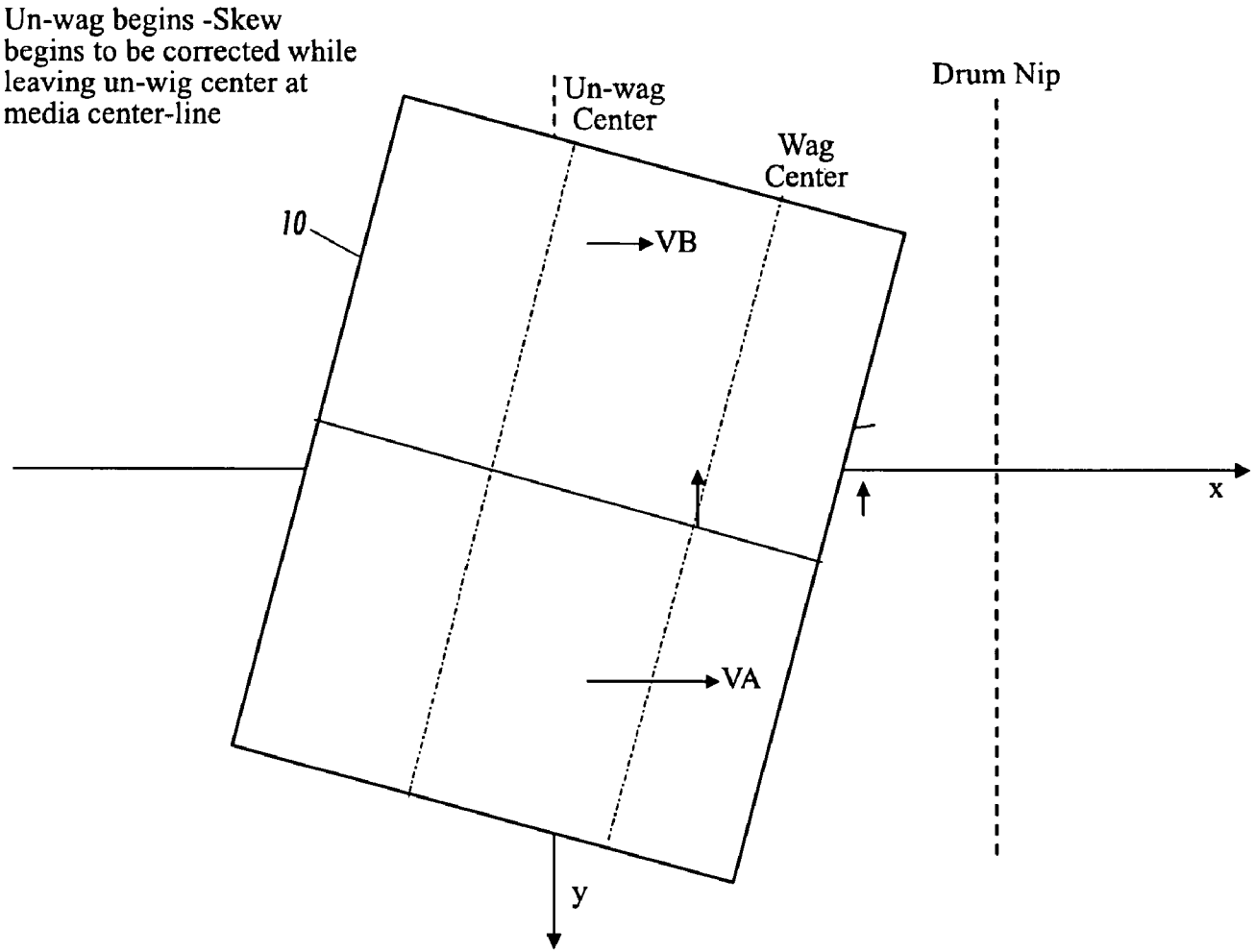
Figure 37:
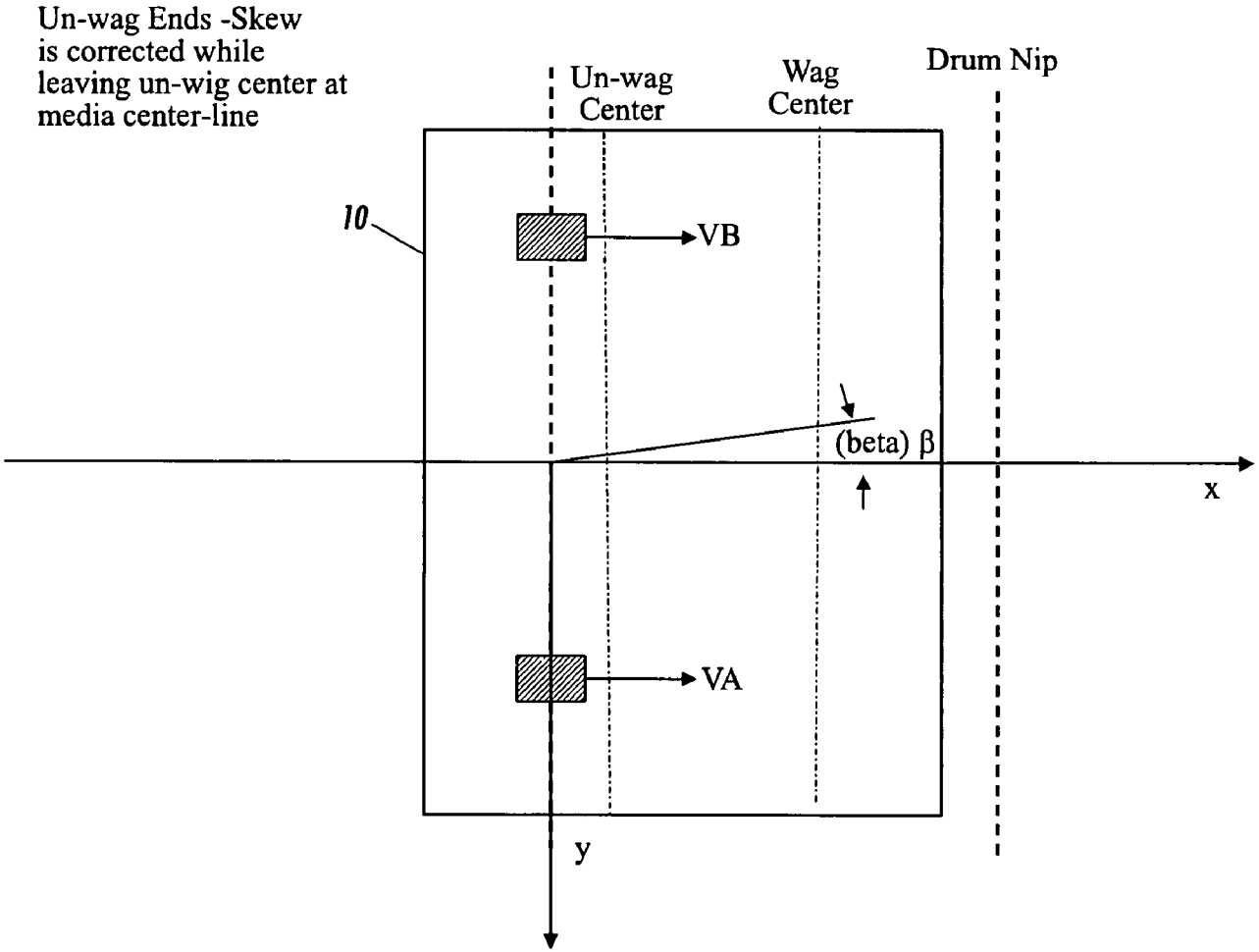

In FIG. 36, unwag begins. In particular, skew begins to be corrected while leaving unwag center at media center line. In FIG. 37, unwag ends. In particular, skew is corrected while leaving unwag center at media center line.

Determining constant process velocity solution may take several steps. Prior to the printing process, the shape of a correction profile may be determined based on several parameters: the process direction position $x_1$ of a sheet where correction begins, the process direction position $x_6$ of the sheet where the correction is expected to be complete, the distance Δx covered during wag and unwag, and the ramp ratio R.

Next, process direction positions x2–x5 may need to be determined based on:

$$x_2=x_1+\Delta x/2 \quad (30)$$

$$x_5=x_6-\Delta x/2 \quad (31)$$

$$x_3=x_1+\Delta x \quad (32)$$

$$x_4=x_6-\Delta x \quad (33)$$

Based on process direction velocity, the time for the sheet to arrive at different process direction positions $t(x_1)$, $t(x_3)$, $t(x_4)$ and $t(x_6)$ may need to be determined. Next, two time parameters $t_{2b}$ and $t_{5b}$, which define timing for two consecutive but opposite sign trapezoidal velocity profiles, may need to be determined as:

$$t_{2B}=t(x_3)-[t(x_3)-t(x_1)]*(1-R)/2 \quad (34)$$

$$t_{5B}=t(x_6)-[t(x_6)-t(x_4)*(1-R)/2 \quad (35)$$

Before reaching nips NA and NB, the incoming skew or initial skew $\beta_0$, as well as incoming lateral error or initial y offset $y_0$ may need to be measured. The wag angle and the unwag angle may need to be determined as:

$$\Delta\beta_W=(y_0-x_5*\beta_0)/(x_5-x_2) \quad (36)$$

$$\Delta\beta_{UW}=(x_2*\beta_0-y_0)/(x_5-x_2) \quad (37)$$

as shown in FIGS. 30 and 31.

Differential angular velocities may need to be determined as:

$$\omega_{WAG}=2*\beta_W/\{[t(x_3)-t(x_1)]*(1+R)\} \quad (38)$$

$$\omega_{WAG}=2*\Delta\beta_{UW}/\{[t(x_6)-t(x_4)]*(1+R)\} \quad (39)$$

Accelerations to differential angular velocities may need to be determined as:

$$\omega_{WAG}=2*\omega_{WAG}/\{t(x_3)-t(x_1)]*(1-R)\} \quad (40)$$

$$\omega_{WAG}=2*\omega_{WAG}/\{[t(x_6)-t(x_4)]*(1-R) \quad (41)$$

Thereafter, angular velocities and accelerations may need to be converted to roller velocities and accelerations:

$$\Delta v(t)=\omega(t)*D/2 \quad (42)$$

$$\Delta\alpha(t)=\alpha(t)*D/2 \quad (43)$$

Table 2 summarizes the information related to wag and unwag at different times. As shown in Table 2, the steps for a constant process velocity solution may be determined.

TABLE 2

| | Time that velocity ramp begins | Target Differential Velocity (in addition to $v_p(t)$) | Differential Acceleration (in addition to $a_p(t)$) |
|---|---|---|---|
| Wag Acceleration | $t(x_1)$ | $\Delta v_A = \Delta v_{WAG}$<br>$\Delta v_B = -\Delta v_{WAG}$ | $\Delta a_A = \Delta a_{WAG}$<br>$\Delta a_B = -\Delta a_{WAG}$ |
| Wag Deceleration | $t_{2B}$ | $\Delta v_A = 0$<br>$\Delta v_B = 0$ | $\Delta a_A = -\Delta a_{WAG}$<br>$\Delta a_B = \Delta a_{WAG}$ |
| Unwag Acceleration | $t(x_4)$ | $\Delta v_A = \Delta v_{UNWAG}$<br>$\Delta v_B = -\Delta v_{UNWAG}$ | $\Delta a_A = \Delta a_{UNWAG}$<br>$\Delta a_B = -\Delta a_{UNWAG}$ |
| Unwag Acceleration | $t_{5B}$ | $\Delta v_A = 0$<br>$\Delta v_B = 0$ | $\Delta a_A = -\Delta a_{WAG}$<br>$\Delta a_B = \Delta a_{WAG}$ |

FIGS. 38 through 41 are referred to in connection with the discussion of a variable process velocity solution. Variable process velocity may be desirable in systems based on their timing requirement.

Figure 38:
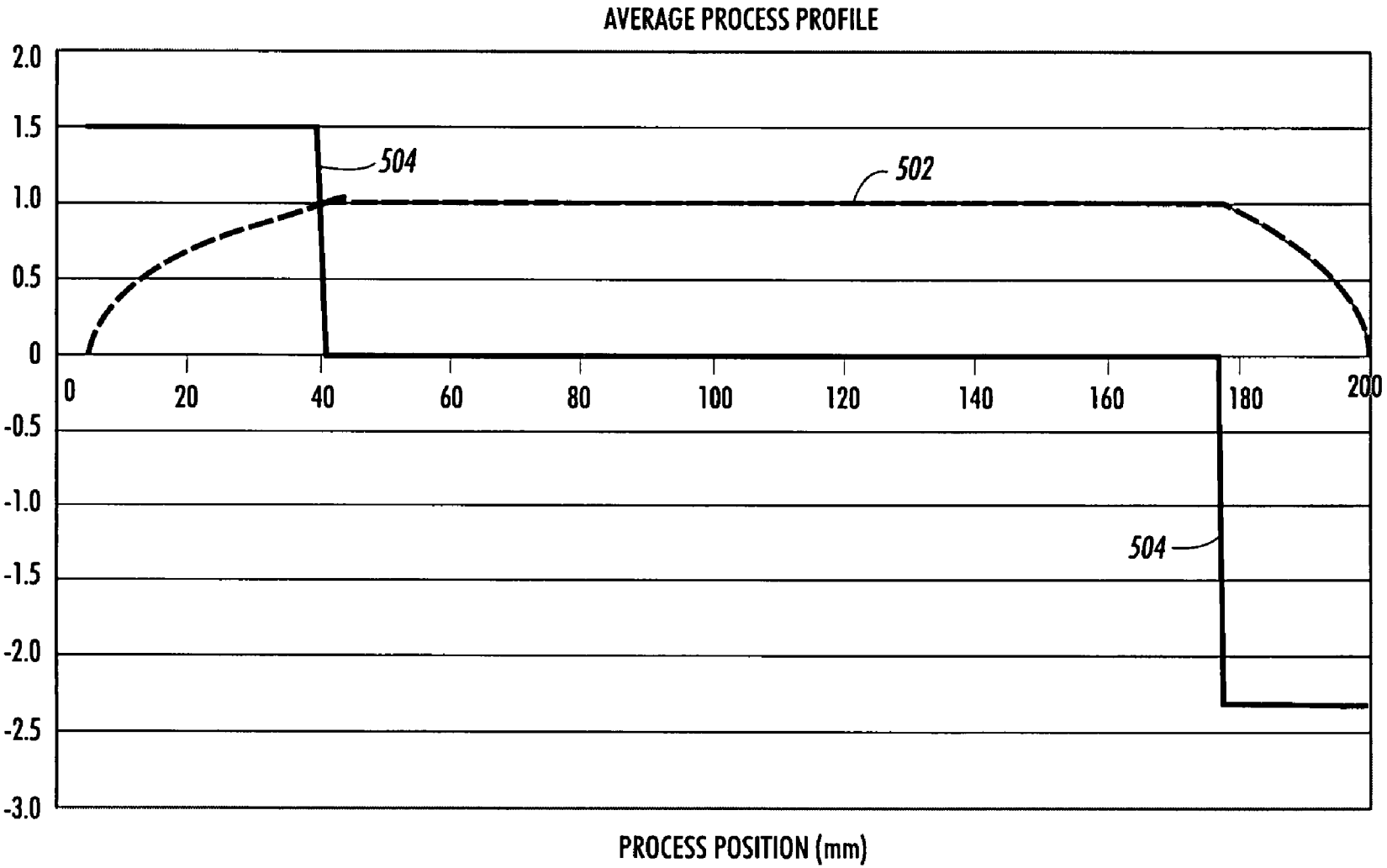
FIGS. 38 through 41 illustrate making corrections to a constant process velocity solution to generate a variable process velocity solution.

For example, FIG. 38 illustrates the process direction profile for 1-up printing, as well as first sheet 2-up printing. In this case, "2-up" printing refers to a method in which the second sheet is printed immediately after the first sheet. "1-up" refers to the common case of one sheet being printed on at a time. As shown in FIG. 38, curve 502 starts after a staging move 5 mm into the registration nip. In FIG. 38, curve 502 represents velocity. Curve 504 represents acceleration.

The same wag and unwag angle solution used for constant velocity may be used for variable process velocity solution. Thus:

$$\Delta\beta_W=\beta_2-\beta_0 \text{ and } \Delta\beta_{UW}-\beta_5-\beta_2=-\beta_2 \quad (44)$$

$$\Delta\beta_W=(y_0-x_5*\beta B_0)/(x_5-x_2) \text{ and } \Delta\beta_{UW}=(x_2*\beta_0-y_0)/(x_5-x_2) \quad (45)$$

The wag and unwag moves occur over the space of Δx, where:

$$x_1=x_2-\Delta x/2,\ x_3=x_2+\Delta x/2,\ x_4=x_5-\Delta x/2,\ x_6=x_5+\Delta x/2 \quad (46)$$

For variable velocity, a time domain profile for angular velocity may be selected such that acceleration and deceleration are constant and equal. The selected time domain profile may also allow the use of constant velocity solution, and is simple to implement in machine software. For example, for a trapezoidal profile, a ramp ratio R may be defined as:

$$R=(t_{2B}-t_{2A})/[t(x_3)-t(x_1)] \quad (47)$$

so that:

$$\Delta\beta_W=\omega_{WAG}*[t(x_3)-t(x_1)]*(1+R)/2 \quad (48)$$

$$\omega_{WAG}=2*\Delta\beta_W/\{[t(x_3)-t(x_1)]*(1+R)\} \quad (49)$$

Similarly:

$$\omega_{WAG}=2*\Delta\beta_{UW}/\{[t(x_6)-t(x_4)]*(1+R)\} \quad (50)$$

Also:

$$t_{2B}=t(x_3)-[t(x_3)-t(x_1)]*(1-R)/2 \text{ and } t_{5B}=t(x_6)-[t(x_6)-t(x_4)]*(1-R)/2 \quad (51)$$

Figure 39:
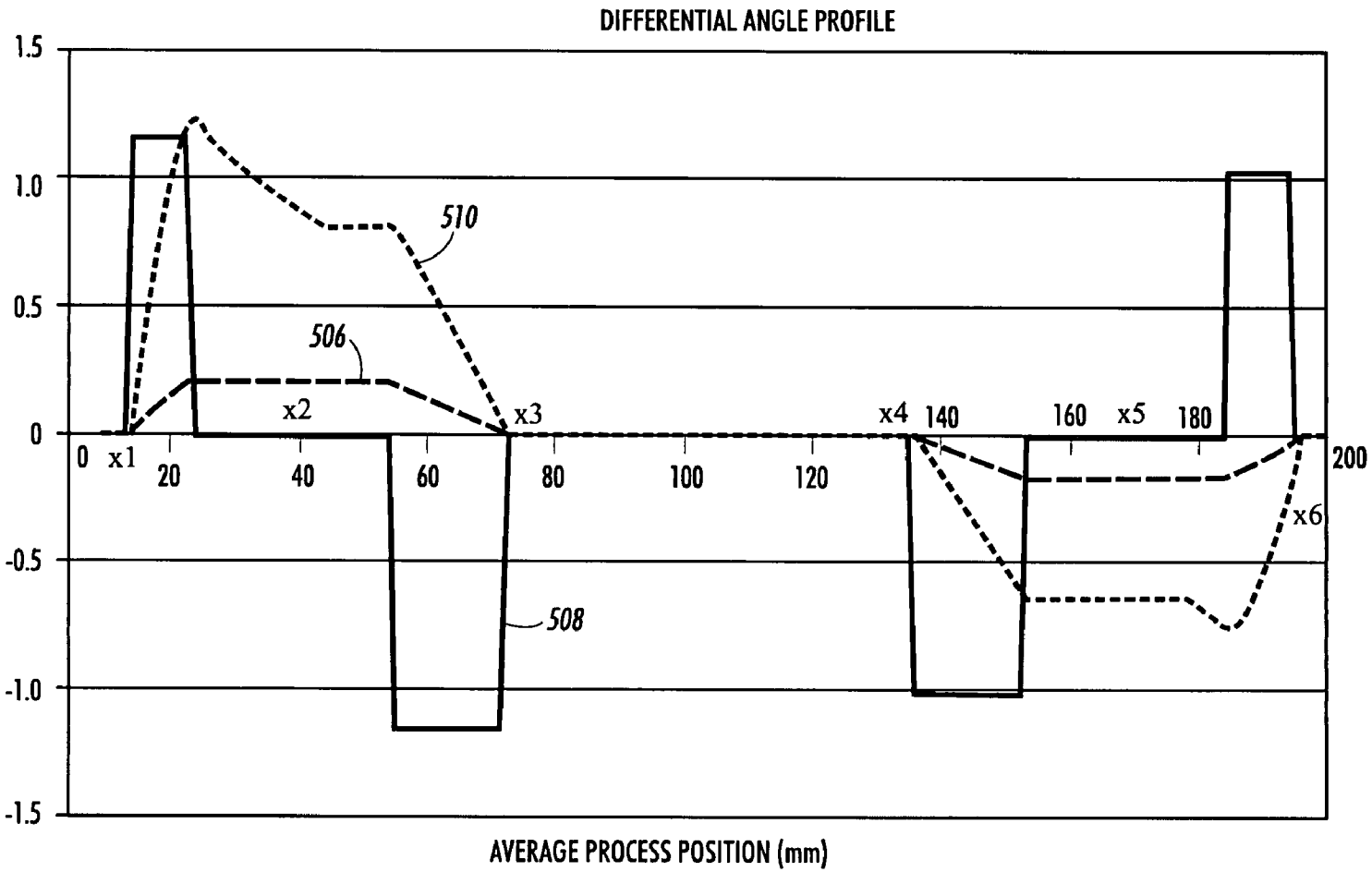

FIG. 39 illustrates a differential motion profile vs. average process position. In FIG. 39, the motion profile is determined in the time domain, thus the result is nonlinear in the position domain. Curve 506 represents differential velocity. Curve 508 represents differential acceleration. Curve 510 represents rate of skew change. As shown in FIG. 39, the rate of skew change 510 in the position domain is not symmetrical about centers of rotation $x_2$ and $x_5$. This lack of symmetry results in a lateral registration error. In the example shown in FIG. 39, the error is 0.6 mm.

In order to correct for the lateral error in a variable velocity case, correction or "fudge" factors may be introduced into the wag and unwag calculations. Because the variable velocity case results in effective centers of rotations that are different from $x_2$ and $x_5$, correction vectors may be used to modify $x_2$ and $x_5$ for the purposes of wag angle calculations:

$$x_2'=x_2-C_W \quad (52)$$

$$x_5'=x_5+C_{UW} \quad (53)$$

Thus:

$$\Delta\beta_W=(y_0-x_5'*\beta_0)/(x_5'-x_2') \quad (54)$$

$$\Delta\beta_{UW}=(x_2'*\beta_0-y_0)/(x_5'-x_2) \quad (55)$$

The wag and unwag moves still occur over the space of Δx, where:

$$x_1=x_2-\Delta x/2,\ x_3=x_2+\Delta x/2,\ x_4=x_5-\Delta x/2,\ x_6=x_5+\Delta x/2 \quad (56)$$

Figure 40:
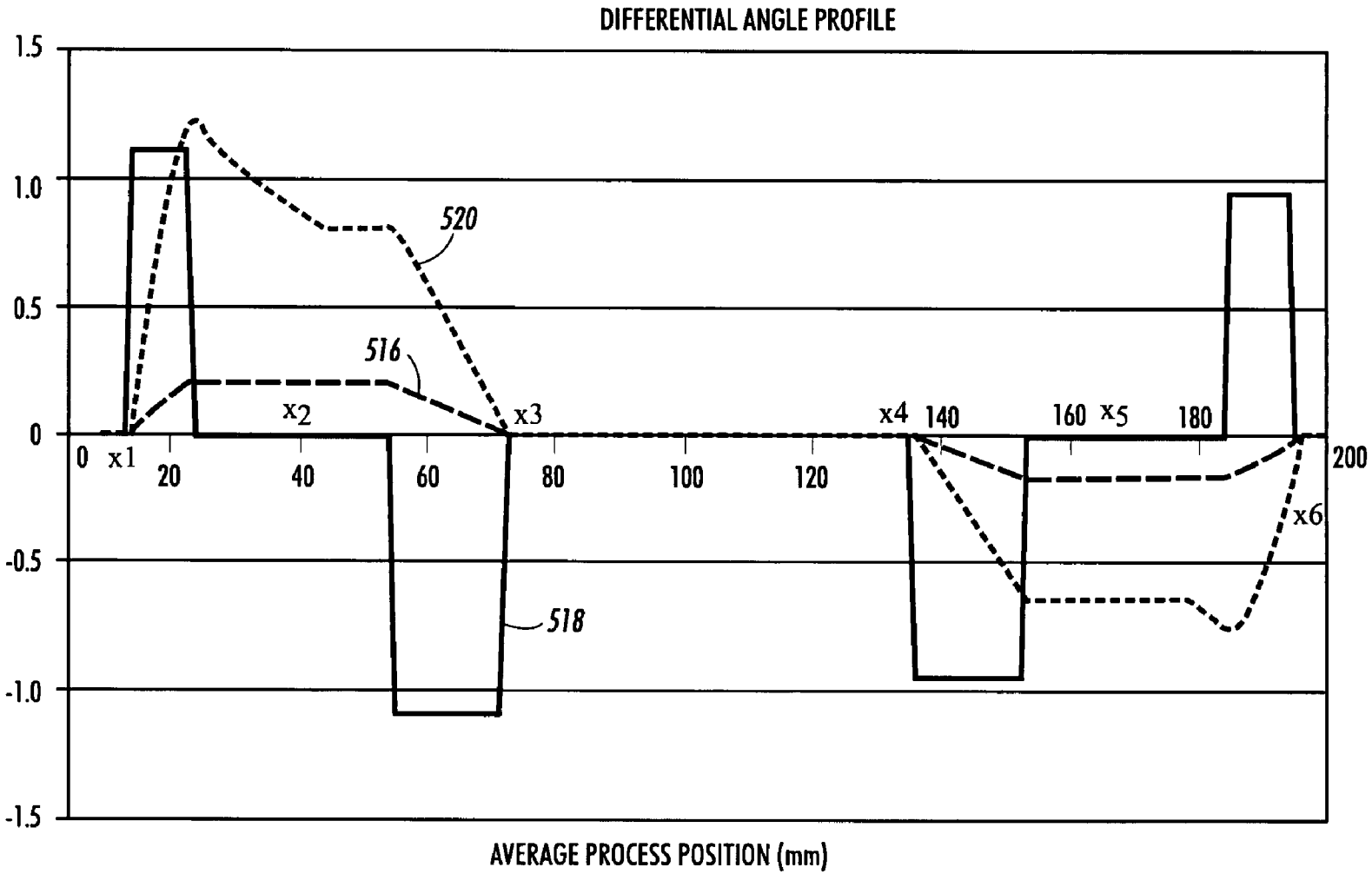

FIG. 40 shows a differential motion profile relative to average process position with the correction factors implemented. As shown in FIG. 40, the curve 516 represents corrected differential velocity. The curve 518 represents the corrected differential acceleration. The curve 520 represents the corrected rate of skew change. In the example shown in FIG. 40, the correction factors used for equations 52 and 53 are $C_W$=5.2 and $C_{UW}$=2.5, respectively. As demonstrated in FIG. 40, the resulting lateral error is less than 0.1 mm.

Figure 41:
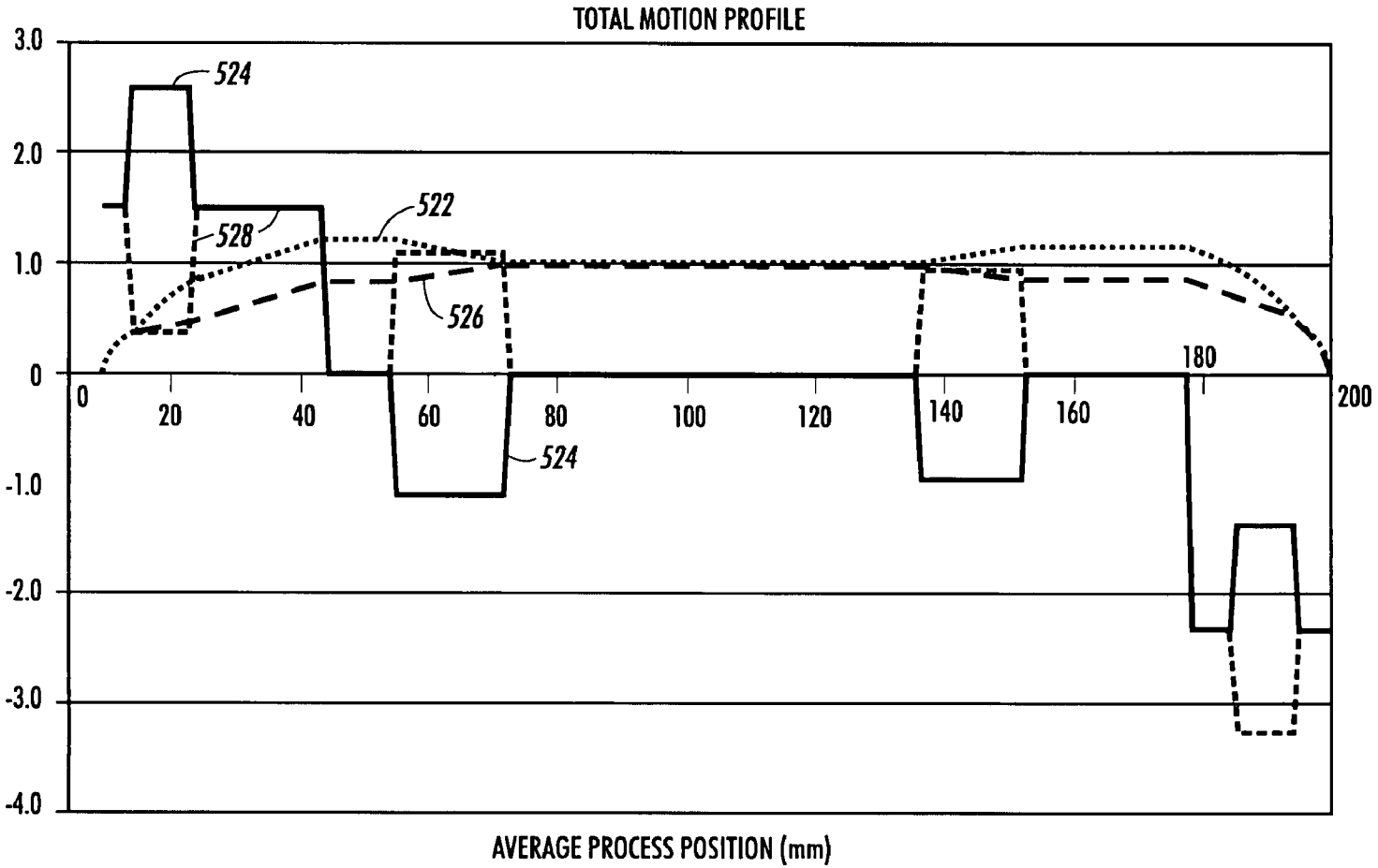

FIG. 41 shows a plot of total roller (nip) velocities and accelerations. In order to minimize roller drive motor power, it is desirable that maximum total accelerations not occur concurrently with maximum velocities.

In FIG. 41, curve 522 represents the velocity of nip NA. Curve 524 represents the acceleration of nip NA. Curves 526 and 528 represent the velocity and acceleration, respectively, of nip NB.

As shown in FIG. 41, angular accelerations occur when curves 524 and 528 separate. Accelerations in the process (longitudinal) direction occur when curves 524 and 528 move together.

As shown in FIG. 41, the maximum total acceleration is 2.6 Gs and occurs during a time of a lower nip velocity of 0.8 meters per second. The maximum total acceleration at maximum nip velocity of 1.2 meters per second is only 1.1 Gs. The maximum total deceleration is a parameter that may not be of concern due to the effect of frictional drag assist in deceleration.

In FIG. 41, a favorable total profile is constructed by predetermining combinations of process velocity profiles and differential velocity profiles that do not overlap accelerations at maximum velocities. The location of the inflection points of the resulting profile are independent of incoming skew, lateral and process errors. Correction of a variety of incoming skew, lateral and process errors is achieved by changes to the magnitudes of the differential velocities.

For determining variable process velocity solution, as discussed above, a plurality of steps may be required. Prior to a printing process, for example, the shape of the correction profile may need to be determined based on $x_1$, the position that differential velocity correction begins; $x_6$, the position at which the differential velocity correction is completed; Δx, the distance covered during wag and unwag; and R, the ramp ratio.

Furthermore, the process direction positions $x_{20}$–$x_5$ may need to be determined based on equations 30-33. Thereafter, corrected values of $x_2$ and $x_5$ may need to be determined based on:

$$x_2'=x_2-C_w \quad (57)$$

$$x_5'=x_5+C_{UW} \quad (58)$$

Next, based on process direction velocity, the times $t(x_1)$, $t(x_3)$, $t(x_4)$ and $t(x_6)$ may be determined. Then, the parameters $t_{2b}$ and $t_{5b}$ may need to be determined according to equations 34 and 35.

Just before reaching nips NA and NB, the incoming skew and incoming lateral errors may be determined. The wag and unwag angles may need to be determined based on:

$$\Delta\beta_W=(y_0-x_5'*\beta_0)(x_5'-x_2') \quad (59)$$

$$\Delta\beta_{UW}=(x_2'*-y_0)/(x_5'-x_2') \quad (60)$$

Thereafter, differential angular velocities and accelerations to differential angular velocities may be determined and converted to roller nip velocities and accelerations based on equations 38-43. In addition, the wag and unwag parameters may be similarly summarized as shown in Table 2.

FIGS. 42 through 45 are flowcharts illustrating medium registration processes, as discussed above. In particular, FIG.

Figure 42:
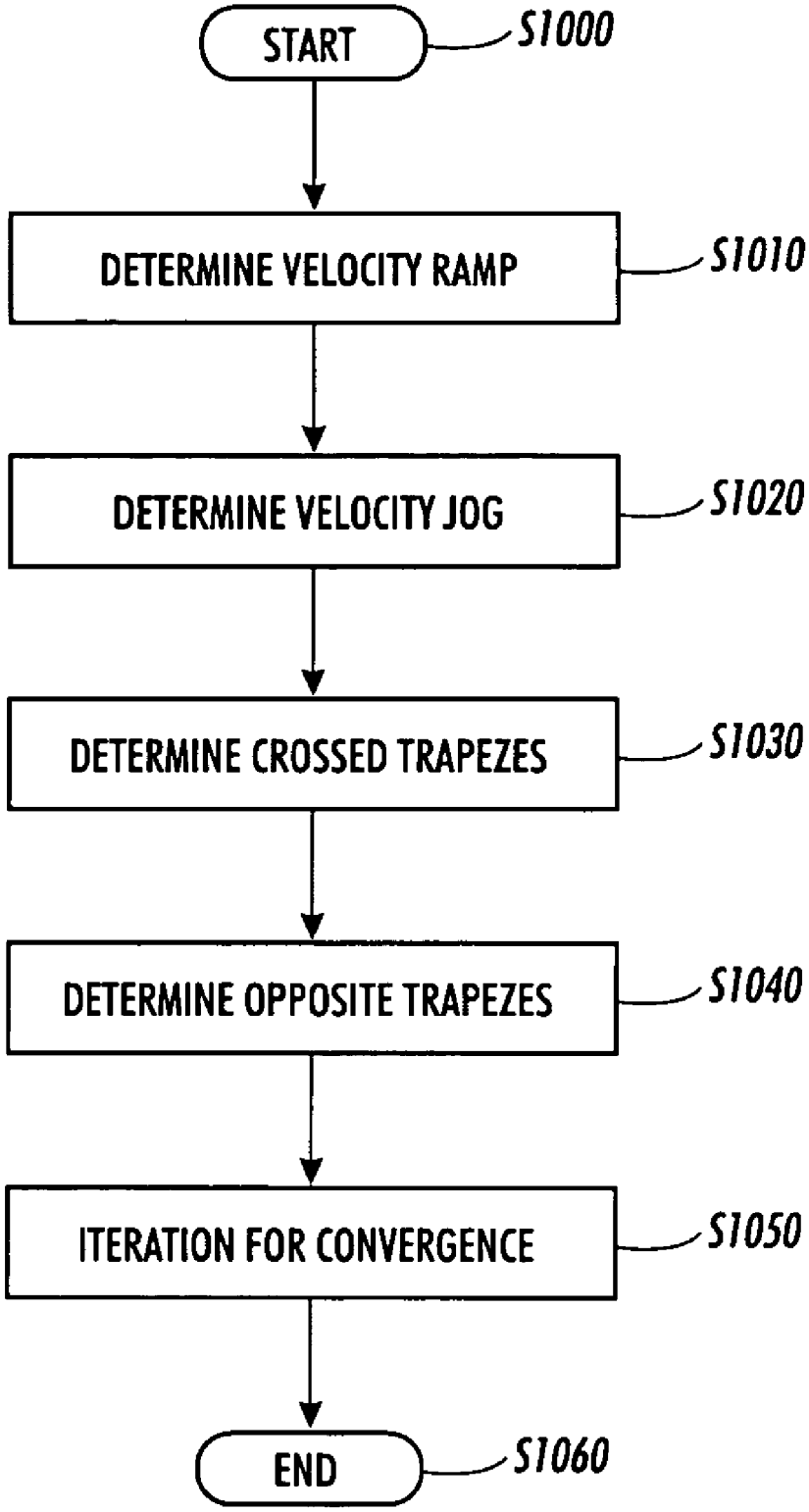
FIG. 42 is a flowchart illustrating an exemplary process of determining nip velocity profiles by parameterization.

42 is a flowchart illustrating a process for determining nip velocity profiles based on parameterization. As shown in FIG. 42, the process starts at step S1000 and proceeds to step S1010 where a velocity ramp is determined as a first piece of standard functions for parameterization. Next, in step S1020, a velocity jog is determined as a second piece of standard functions for parameterization. The process proceeds to step S1030.

In step S1030, a pair of crossed trapezoids is determined as a third piece of standard functions for parameterization. Next, in step S1040, a pair of opposite trapezoids is determined as a fourth piece of standard functions for parameterization. Thereafter, iteration is performed for convergence of the parameters at step S1050. Then, the process proceeds to step S1060, where the process ends.

Figure 43:
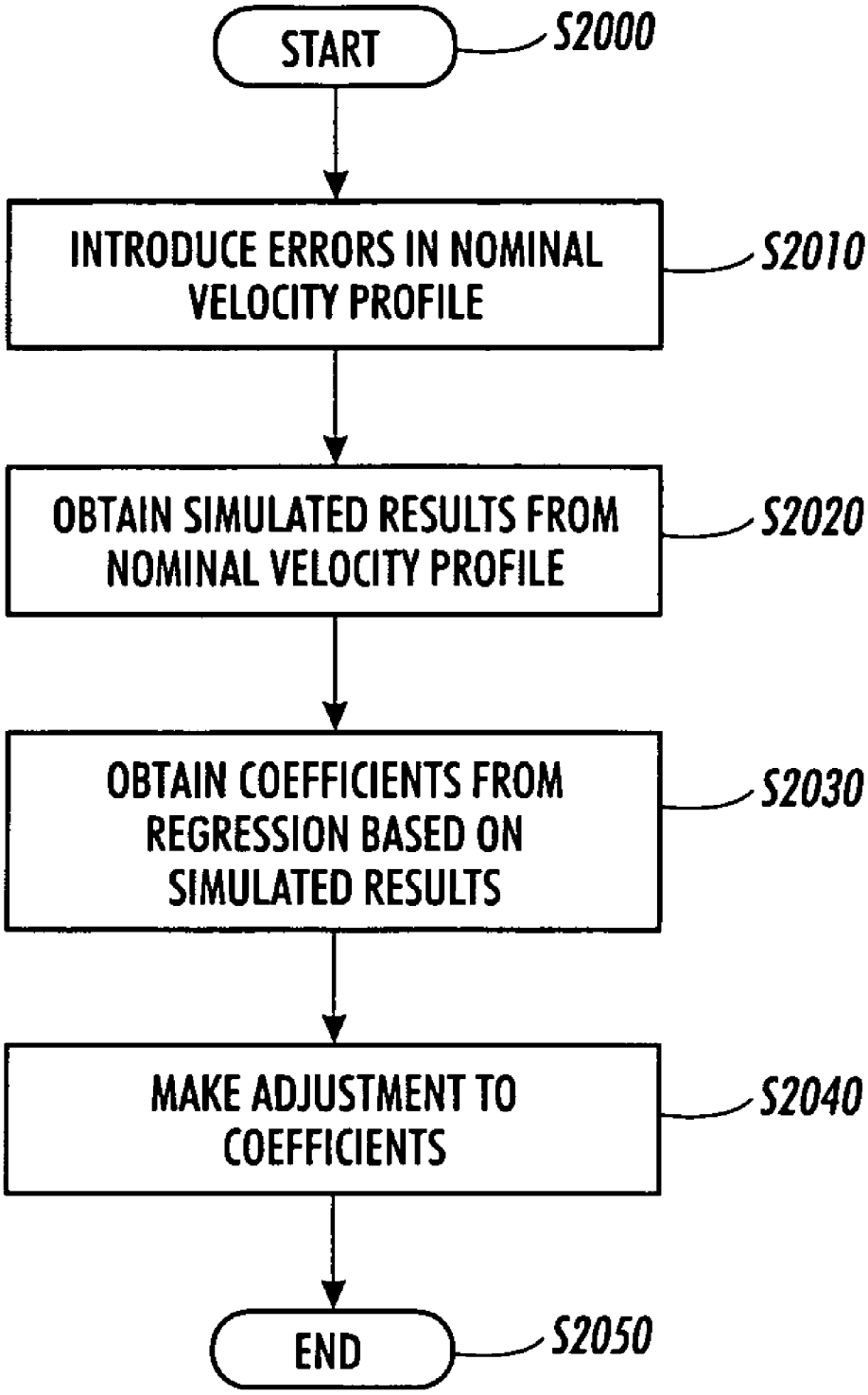
FIG. 43 is a flowchart illustrating an exemplary process of simulating a medium registration process.

FIG. 43 is a flowchart illustrating a simulation process. Starting from step S2000, the process proceeds to step S2010 where error parameters, such as skew, lateral offset and/or process errors may be introduced into a nominal velocity profile. Next, in step S2020, output results are obtained based on the nominal velocity profile and the error parameters introduced to the nominal velocity profile. The process then proceeds to step S2030.

At step S2030, regression is performed based on the output results, with a set of coefficients generated to represent relationships between the output results and the error parameters. Then, in step S2040, the coefficients are adjusted. Thereafter, the process proceeds to step S2050, where the process ends.

Figure 44:
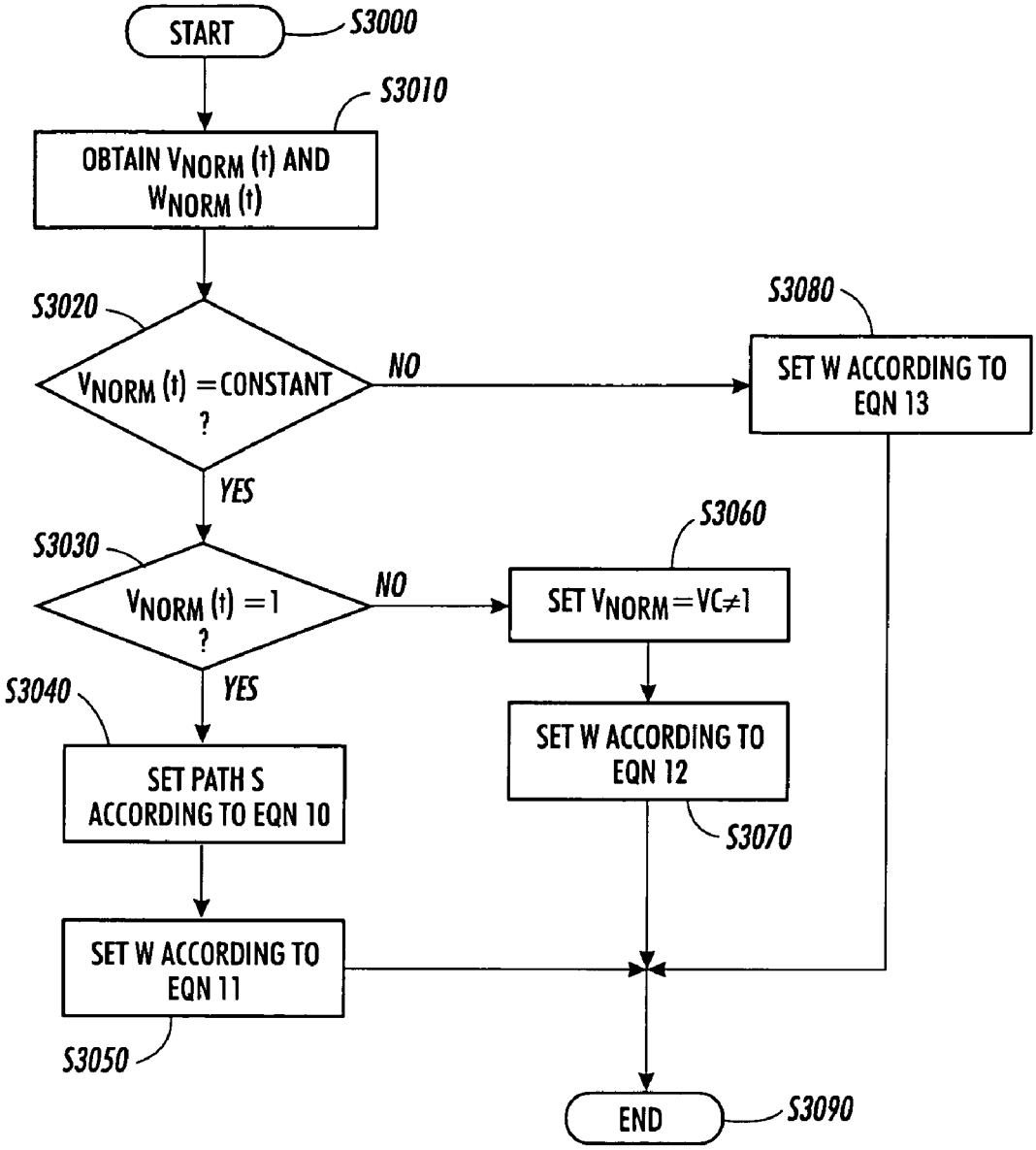
FIG. 44 is a flowchart illustrating an exemplary process of determining an angular velocity as a function of path.

FIG. 44 is a flowchart illustrating a process for determining an angular velocity as a function of path. As shown in FIG. 44, the process begins at step S3000, and proceeds to step S3010 where nominal velocity and angular velocity as functions of time are derived. Next, in step S3020, a determination is made whether the nominal velocity is a constant.

If it is determined that the nominal velocity is a constant at step S3020, process jumps to step S3080, where the angular velocity is determined by Equation 13. Thereafter, the process proceeds to step S3090, where the process ends.

On the other hand, if it is determined at step S3020 that the nominal velocity is a constant, the process proceeds to step S3030, where a determination is made whether the nominal velocity is equal to unity. If it is determined at step S3030 that the nominal velocity is not equal to unity, the process jumps to step S3060, where the value of the nominal velocity is determined. Thereafter, the process proceeds to step S3070, where the angular velocity is determined by Equation 12. Subsequently, the process proceeds to step S3090, where the process ends.

However, if it is determined at step S3030 that the nominal velocity is equal to 1, the process proceeds to step S3040 where the path is determined according to Equation 10. Thereafter, the process proceeds to step S3050, where the angular velocity is determined according to Equation 13 and the path determined at step S3040. Subsequently, the process proceeds to step S3090, where the process ends.

Figure 45:
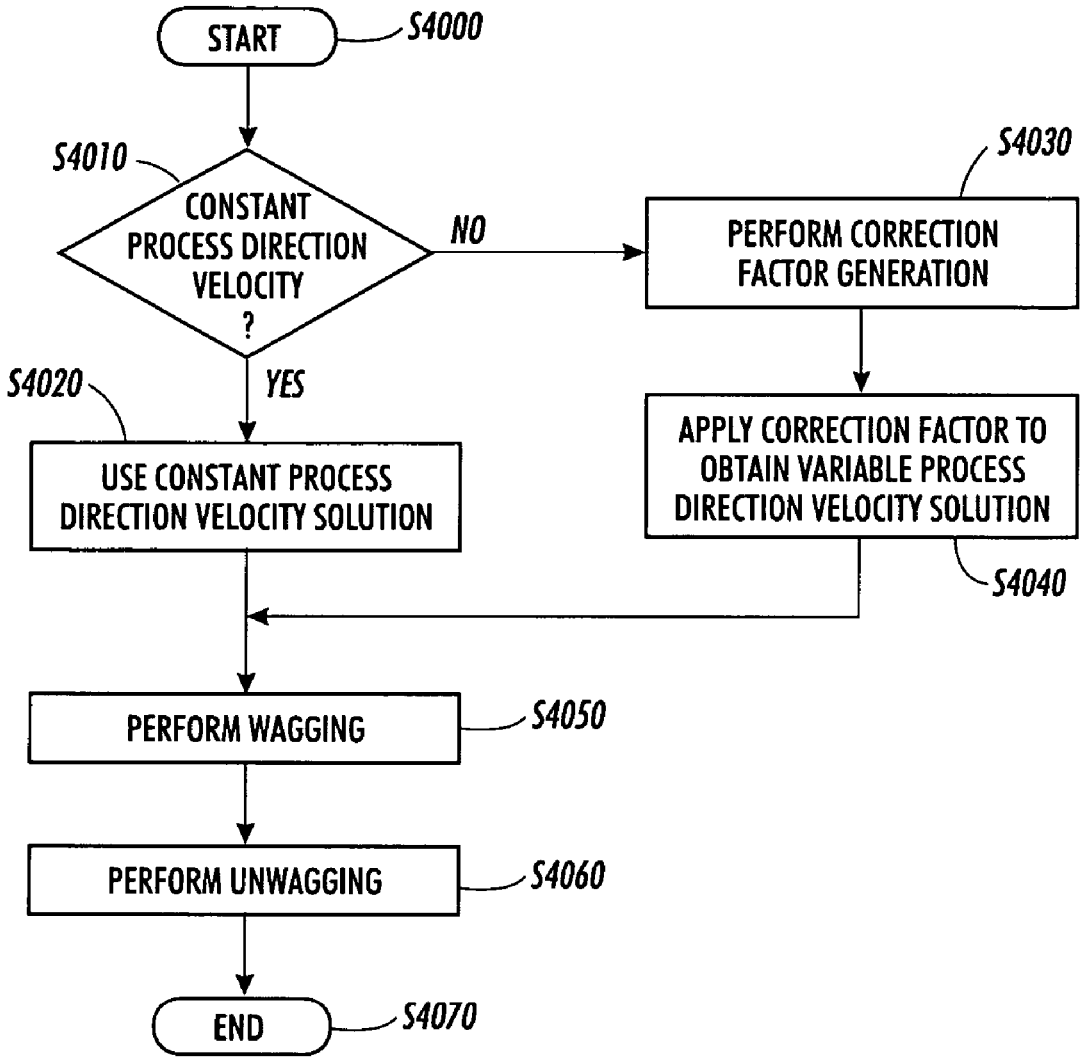
FIG. 45 is a flowchart illustrating an exemplary wagging and unwagging process.

FIG. 45 is a flowchart illustrating a wagging and unwagging process. As shown in FIG. 45, the process starts at step S4000 and proceeds to step S4010, where a determination is made whether the process velocity of a medium is constant. If it is determined at step S4010 that the process velocity is a constant, the constant process of velocity solution is used for wagging and unwagging. Thereafter, the process proceeds to step S4050.

However, if it is determined at step S4010 that the process velocity is variable, the process proceeds to step S4030 where a correction factor or a "fudge" factor is determined. Thereafter, the correction factor is applied to the constant process velocity solution to generate a variable process velocity solution. Then, the process proceeds to step S4050.

At step S4050, wagging is performed. Next, in step S4060, unwagging is performed. Subsequently, in step S4070, the process ends.

The methods illustrated in FIGS. 42 through 45 may be implemented in computer program products that can be executed on a computer. The computer program products may be computer-readable recording media on which control programs are recorded, or they may be transmittable carrier waves in which the control programs are embodied as data signals. In addition, the computer program products may be used in an apparatus, such as a xerographic device, that may be used to control nips in a medium registration system.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of determining nip velocity profiles in a medium registration system of a printer, comprising:

parameterizing a set of equations representing an analytic form of the nip velocity profiles;

determining values of the parameters applicable to any specific situation through simulation and an iteration process; and determining the nip velocity profiles based on the determined values of the parameters, wherein the printer determines the nip velocity profiles.

2. The method of claim 1, the parameterizing step comprising:

determining a velocity ramp that indicates a change in nip speed from an input velocity to an output velocity;

determining a velocity jog that indicates a change in a process direction position of a medium;

determining a pair of crossed trapezoids that indicate a change of cross process direction position of the medium; and determining a pair of opposite trapezoids that indicate an angular change of the medium.

3. The method of claim 2, wherein:

determining a pair of crossed trapezoids comprises determining the pair of crossed trapezoids when there is no angular change of the medium; and determining a pair of opposite trapezoids comprises determining the pair of opposite trapezoids when there is no cross process direction position change of the medium.

4. The method of claim 2, determining a pair of opposite trapezoids comprises determining the angular change of the medium by:

$$\Delta A = 0.5 * \Delta\beta / (D * T_{ramp})$$

where delta A is the angular change, $\Delta\beta$ is an initial angular offset, D is a distance between two nips in the cross process direction, and $T_{ramp}$ is a time interval during which the angular change is determined.

5. A computer-readable medium including computer-executable instructions for performing the method recited in claim 1, the computer-readable medium further comprising instructions for controlling a controller.

6. A printing apparatus, comprising:

a controller that controls the nip in the medium registration system, the controller being instructed by a computer having the computer-readable medium recited in claim 5.

7. A xerographic marking device including the apparatus of claim 6.

8. A printer having a processor for implementing the parameters derived by the method of claim 1.

9. A method of simulating a medium registration process, comprising:

inputting an error to a velocity nominal profile of a nip in a medium registration system;

determining an output value based on the error;

using the output value in a regression procedure to obtain a simulated relationship, the simulated relationship indicative of a manner in which the error influences the output value; and using the simulated relationship to control printing operations of a printer.

10. The method of claim 9, wherein the error comprises:

a skew of the medium;

a cross process direction offset; and a process direction error.

11. The method of claim 10, wherein using the output value in a regression process comprises using the output value in a multi-linear regression process.

12. The method of claim 9, wherein inputting an error to a velocity nominal profile comprises inputting the error parameter to a constant velocity nominal profile.

13. The method of claim 9, wherein inputting an error parameter to a velocity nominal profile comprises inputting the error parameter to a trapezoidal velocity nominal profile.

14. The method of claim 9, further comprising:

determining a correction term V as:

$$V = \frac{-(1 - K * W)y_m - a_2\beta_m}{a_3}$$

where $y_m$ is a measured input lateral, $\beta_m$ is a measured input skew error, $a_2$ is a coefficient of skew of the medium, $a_3$ is a coefficient of lateral amplitude of the medium, W is a process direction position of the medium, and K is a gain determined based on process direction correction; and adding the correction term to the simulated relationship.

15. A computer-readable medium including computer-executable instructions for performing the method recited in claim 9, the computer-readable medium further comprising instructions for controlling a controller.

16. An apparatus, comprising:

a controller that controls the nip in the medium registration system, the controller being instructed by a computer having the computer-readable medium recited in claim 15.

17. A xerographic marking device including the apparatus of claim 16.

18. A printer having a memory and a controller for executing the method of claim 9.

19. A printing apparatus used in connection with a medium registration system, the medium registration system including at least a nip and a sensor or sensor system, the sensors detect position of a medium, the printing apparatus comprising:

a memory that stores simulated relationships between an error parameter applied to a nip velocity nominal profile and an output value of the nominal profile; and a controller that controls the nip in the medium registration system, wherein the controller determines desired correction parameters based on input from the sensor and based on the simulated relationships, and controls a velocity profile of the nip based on the desired correction parameters.

20. The apparatus of claim 19, wherein input from the sensor or sensor system comprising:

a detected skew of the medium;

a detected cross process direction offset of the medium; and a detected process direction error of the medium.

21. The apparatus of claim 19, wherein the nominal profile is a constant velocity nominal profile.

22. The apparatus of claim 19, wherein the nominal profile is a trapezoidal velocity nominal profile.

23. The apparatus of claim 19, wherein:

the memory stores a correction term V of:

$$V = \frac{-(1 - K * W)y_m - a_2\beta_m}{a_3}$$

where ym is a measured input lateral, beta m is a measured input skew error, $a_2$ is a coefficient of skew of the medium, $a_3$ is a coefficient of lateral amplitude of the medium, W is a process direction position of the medium, and K is a gain determined based on process direction correction; and the controller uses the correction term when determining the desired correction parameters.

24. The apparatus of claim 19, wherein:

the memory stores the simulated relationships in a form of a look-up-table (LUT); and the controller uses the look-up-table when determining the desired correction parameters, performing interpolation when needed.

25. A xerographic marking device including the apparatus of claim 19.

* * * * *